US009631266B2

(12) United States Patent
Futamura et al.

(10) Patent No.: US 9,631,266 B2
(45) Date of Patent: Apr. 25, 2017

(54) METHOD FOR MANUFACTURING HIGH-STRENGTH COLD-ROLLED STEEL SHEET WITH OUTSTANDING WORKABILITY

(71) Applicant: KOBE STEEL, LTD., Kobe-shi (JP)

(72) Inventors: Yuichi Futamura, Kakogawa (JP); Michiharu Nakaya, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 14/382,450

(22) PCT Filed: Feb. 28, 2013

(86) PCT No.: PCT/JP2013/055571

§ 371 (c)(1),
(2) Date: Sep. 2, 2014

(87) PCT Pub. No.: WO2013/146087

PCT Pub. Date: Oct. 3, 2013

(65) Prior Publication Data

US 2015/0101712 A1 Apr. 16, 2015

(30) Foreign Application Priority Data

Mar. 29, 2012 (JP) ..... 2012-078152
Dec. 12, 2012 (JP) ..... 2012-271793

(51) Int. Cl.
*C22C 38/38* (2006.01)
*C22C 38/06* (2006.01)
(Continued)

(52) U.S. Cl.
CPC ..... *C22C 38/38* (2013.01); *C21D 1/20* (2013.01); *C21D 1/22* (2013.01); *C21D 8/0447* (2013.01);
(Continued)

(58) Field of Classification Search
CPC ..... C21D 9/46; C22C 38/002; C22C 38/005; C22C 38/02; C22C 38/04; C22C 38/06;
(Continued)

(56) References Cited

U.S. PATENT DOCUMENTS

2003/0047257 A1 3/2003 Kami et al.
2005/0161134 A1 7/2005 Ikeda et al.
(Continued)

FOREIGN PATENT DOCUMENTS

CN 102140608 A 8/2011
CN 102149840 A 8/2011
(Continued)

OTHER PUBLICATIONS

International Search Report issued May 21, 2013 in PCT/JP13/055571, filed Feb. 28, 2013.
(Continued)

*Primary Examiner* — Jessee Roe
*Assistant Examiner* — Anthony Liang
(74) *Attorney, Agent, or Firm* — Oblon, McClelland, Maier & Neustadt, L.L.P.

(57) ABSTRACT

Provided is a method that enables manufacture, with good productivity, of a high-strength cold-rolled steel with improved elongation (EL), stretch-flangeability (λ), bendability (R), and balance of these properties (TS×EL×λ/1000), outstanding composite workability as evaluated by Erichsen test, and a tensile strength of at least 980 MPa. A steel material satisfying a prescribed constituent composition is held and soaked for at least fifty seconds at a temperature at or above the $Ac_3$ point, after which the steel material is cooled at an average cooling rate of at least 15° C./sec to a discretionary temperature (T) that satisfies expression (1) below, held for 5-180 seconds in a temperature range that satisfies expression (1) below, then heated to
(Continued)

a temperature region that satisfies expression (2) below, held for at least 50 seconds in this temperature region, and then cooled.

$$300° \text{ C.} \leq T1(° \text{ C.}) < 400° \text{ C.} \quad (1)$$

$$400° \text{ C.} \leq T2(° \text{ C.}) < 540° \text{ C.} \quad (2)$$

14 Claims, 2 Drawing Sheets

(51) Int. Cl.

| | |
|---|---|
| ***C22C 38/04*** | (2006.01) |
| ***C22C 38/02*** | (2006.01) |
| ***C21D 9/46*** | (2006.01) |
| ***C22C 38/00*** | (2006.01) |
| ***C21D 8/04*** | (2006.01) |
| ***C21D 1/20*** | (2006.01) |
| ***C21D 1/22*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C23C 2/02*** | (2006.01) |
| ***C25D 5/36*** | (2006.01) |

(52) U.S. Cl.
CPC ..... *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C23C 2/02* (2013.01); *C25D 5/36* (2013.01); *C21D 2211/001* (2013.01); *C21D 2211/002* (2013.01); *C21D 2211/008* (2013.01)

(58) Field of Classification Search
CPC ..... C22C 38/08; C22C 38/12; C22C 38/14; C22C 38/16; C22C 38/38
USPC ..... 148/518
See application file for complete search history.

(56) References Cited

U.S. PATENT DOCUMENTS

| | | | |
|---|---|---|---|
| 2008/0251161 | A1 | 10/2008 | Kashima et al. |
| 2009/0277547 | A1 | 11/2009 | Saito et al. |
| 2010/0172786 | A1 | 7/2010 | Nakaya et al. |
| 2010/0221138 | A1 | 9/2010 | Nakaya et al. |
| 2011/0146852 | A1 | 6/2011 | Matsuda et al. |
| 2011/0186189 | A1 | 8/2011 | Futamura |
| 2013/0133786 | A1 | 5/2013 | Matsuda et al. |

FOREIGN PATENT DOCUMENTS

| | | |
|---|---|---|
| JP | 2002-53931 | 2/2002 |
| JP | 2004-277858 | 10/2004 |
| JP | 2005-240178 | 9/2005 |
| JP | 2006-274417 | 10/2006 |
| JP | 2007-321236 | 12/2007 |
| JP | 2007-321237 | 12/2007 |
| JP | 10-280090 | 10/2008 |
| JP | 2008-297592 | 12/2008 |
| JP | 2010-90475 | 4/2010 |
| JP | 2011-157583 | 8/2011 |
| JP | 2011-184757 | 9/2011 |
| JP | 2001-335889 | 12/2012 |

OTHER PUBLICATIONS

Written Opinion of the International Searching Authority issued May 21, 2013 in PCT/JP13/055571, filed Feb. 28, 2013.

METHOD FOR MANUFACTURING HIGH-STRENGTH COLD-ROLLED STEEL SHEET WITH OUTSTANDING WORKABILITY

TECHNICAL FIELD

The present invention relates to a method for manufacturing a cold-rolled steel sheet. Specifically, the invention relates to a method for manufacturing a high-strength cold-rolled steel sheet having a tensile strength of at least 980 MPa.

BACKGROUND ART

Today, response to global environmental issues such as $CO_2$ restrictions is an urgent matter in the automotive industry. On the other hand, from the viewpoint of ensuring safety of passengers, collision safety standards of automobiles have been strengthened, and there has been progressing a structural design for sufficiently ensuring safety in an in-vehicle space. To achieve such demands together, it is effective that a high-strength steel sheet (high-tensile steel sheet) having a tensile strength of at least 980 MPa is used for structural members of the automobile, and is reduced in thickness to lighten a vehicle body. However, higher strength of a steel sheet in general leads to degradation of workability. Hence, when a high-tensile steel sheet is applied to automobile members, improving workability of the steel sheet is an inevitable issue.

Known steel sheets having both strength and workability include TRIP (Transformation Induced Plasticity) steel sheets. A TBF steel sheet including bainitic ferrite as a parent phase and retained austenite is known as one of the TRIP steel sheets (PTL 1 to PTL 4). The TBF steel sheet has high strength due to the hard bainitic ferrite, and has excellent elongation (EL) and stretch-flangeability (λ) due to the fine retained-austenite located in a grain boundary of the bainitic ferrite, and therefore has high strength and excellent workability together.

PTL 5 discloses a method of manufacturing a high-strength steel sheet having a tensile strength of at least 980 MPa and having good elongation and good stretch-flangeability. In this manufacturing method, a steel sheet containing at least 0.10 mass % of C is heated into an austenite single-phase region or a duplex (austenite and ferrite) region. Subsequently, the steel sheet is cooled to a target cooling end temperature that is set, with a martensitic transformation start temperature Ms as an index, in a temperature region of lower than Ms and at least Ms−150° C. Thus, part of untransformed austenite is transformed into martensite, and then the steel sheet is heated to temper the martensite.

CITATION LIST

Patent Literature

PTL 1: Japanese Unexamined Patent Application Publication No. 2005-240178.

PTL 2: Japanese Unexamined Patent Application Publication No. 2006-274417.

PTL 3: Japanese Unexamined Patent Application Publication No. 2007-321236.

PTL 4: Japanese Unexamined Patent Application Publication No. 2007-321237.

PTL 5: Japanese Unexamined Patent Application Publication No. 2011-184757.

PTL 6: Japanese Unexamined Patent Application Publication No. 2011-157583.

SUMMARY OF INVENTION

Technical Problem

Recently, the $CO_2$ restrictions have been made strict more and more, and demands for a light body are further increased. It is therefore investigated to apply a high-tensile steel sheet having a tensile strength of at least 980 MPa to a less formable member for which a low-strength steel sheet having high workability has been used. Specifically, it is considered to actively use the high-tensile steel sheet not only for a frame member of the body but also for a sheet member. Hence, the high-tensile steel sheet having a tensile strength of at least 980 MPa is also strongly required to be further improved in general workability including elongation and local deformability such as stretch-flangeability (hole expandability) and bendability.

However, PTL 1 to PTL 5 have not investigated on improvement in general workability including local deformability such as bendability while investigating improvement in strength, elongation, and stretch-flangeability.

The inventors have therefore disclosed, in PTL 6, a high-strength cold-rolled steel sheet having a tensile strength of at least 980 MPa and having excellent general workability, which is improved in all properties of elongation (EL), stretch-flangeability (λ), and bendability (R) in a well-balanced manner. A microstructure of the high-strength cold-rolled steel sheet is characterized by including bainite, retained austenite, and tempered martensite, where (1) when the microstructure is observed by a scanning electron microscope, the bainite is composed of a composite structure of high-temperature-region-formed bainite, in which an average distance between adjacent retained-austenite grains and/or carbide particles is 1 μm or more, and low-temperature-region-formed bainite, in which an average distance between adjacent retained-austenite grains and/or carbide particles is less than 1 μm, and when an area fraction of the high-temperature-region-formed bainite in the entire microstructure is denoted as "a", and when a total area fraction of the low-temperature-region-formed bainite and the tempered martensite in the entire microstructure is denoted as "b", a: 20 to 80%, b: 20 to 80%, and a+b: 70% or more are satisfied, and (2) a volume fraction of the retained austenite determined by saturation magnetization measurement is 3% or more with respect to the entire microstructure.

PTL 6 further discloses a method of manufacturing the high-strength cold-rolled steel sheet, including in sequence a step of heating the steel sheet to a temperature equal to or higher than the $Ac_3$ point and then soaking the steel sheet for 50 sec or more, a step of cooling the steel sheet down to an appropriate temperature T in a temperature region of 400° C. or higher and 540° C. or lower at an average cooling rate of 15° C./sec or higher, a step of holding the steel sheet for 5 to 100 sec in the temperature region of 400° C. or higher and 540° C. or lower, and a step of holding the steel sheet for 200 sec or more in the temperature region of 200° C. or higher and lower than 400° C. to perform austempering treatment. In this manufacturing method, however, the austempering treatment where the steel sheet is held in the temperature region of 200° C. or higher and lower than 400° C. must be performed for at least 200 sec. Hence, productivity has been difficult to be improved.

Recently, the steel sheet is also required to be improved in composite workability as evaluated by Erichsen test. In PTL 6, however, although elongation (EL), stretch-flangeability (λ), bendability (R), and balance of these properties (TS×EL×λ/1000) are improved, the composite workability as evaluated by Erichsen test is not investigated.

An object of the invention, which has been made in light of the above-described circumstances, is to provide a method of manufacturing a high-strength cold-rolled steel sheet having a tensile strength of at least 980 MPa with great productivity, the steel sheet being improved in elongation (EL), stretch-flangeability (λ), bendability (R), and balance of these properties (TS×EL×λ/1000), and being excellent in composite workability as evaluated by Erichsen test.

Solution to Problem

According to the present invention, there is provided a method of manufacturing a high-strength cold-rolled steel sheet, which has succeeded in solving the above-described issues, the steel sheet satisfying, by mass percent, C: 0.10 to 0.3%, Si: 1.0 to 3%, Mn: 1.5 to 3%, Al: 0.005 to 3%, P: 0.1% or less, and S: 0.05% or less, the remainder consisting of iron and inevitable impurities, a microstructure of the steel sheet including bainite, retained austenite, and tempered martensite, wherein (1) when the microstructure is observed by a scanning electron microscope, the bainite is composed of a composite structure of high-temperature-region-formed bainite, in which an average distance between adjacent retained-austenite grains and/or carbide particles is 1 μm or more, and low-temperature-region-formed bainite, in which an average distance between adjacent retained-austenite grains and/or carbide particles is less than 1 μm, and when an area fraction of the high-temperature-region-formed bainite in the entire microstructure is denoted as "a", and when a total area fraction of the low-temperature-region-formed bainite and the tempered martensite in the entire microstructure is denoted as "b", a: 20 to 80%, b: 20 to 80%, and a+b: 70% or more are satisfied, and (2) a volume fraction of the retained austenite determined by saturation magnetization measurement is 3% or more with respect to the entire microstructure, the method being summarized in that steel satisfying the above-described constituent composition is held for 50 sec or more at a temperature equal to or higher than a $Ac_3$ point so as to be soaked, and then cooled to an appropriate temperature T satisfying Formula (1) at an average cooling rate of 15° C./sec or higher, and is held in a temperature region satisfying Formula (1) for 5 to 180 sec, and then heated into a temperature region satisfying Formula (2) and held in the temperature region for 50 sec or more, and is then cooled. In this description, the low-temperature-region-formed bainite and tempered martensite may be collectively referred to as "low-temperature-region-formed bainite, etc."

$$300° \text{ C.} \leq T1(° \text{ C.}) < 400° \text{ C.} \quad (1)$$

$$400° \text{ C.} \leq T2(° \text{ C.}) \leq 540° \text{ C.} \quad (2)$$

The steel may further contain other elements including (a) Cr: 1% or less (not including 0%) and/or Mo: 1% or less (not including 0%), (b) at least one element selected from the group consisting of Ti: 0.15% or less (not including 0%), Nb: 0.15% or less (not including 0%), and V: 0.15% or less (not including 0%), (c) Cu: 1% or less (not including 0%) and/or Ni: 1% or less (not including 0%), (d) B: 0.005% or less (not including 0%), and (e) at least one element selected from the group consisting of Ca: 0.01% or less (not including 0%), Mg: 0.01% or less (not including 0%), and rare earth elements: 0.01% or less (not including 0%).

When the microstructure has a MA mixed phase including quenched martensite compound with retained austenite, a ratio of the number of grains of the MA mixed phase, each grain having a circle-equivalent diameter d satisfying more than 3 μm on a viewing section, in the total number of grains of the MA mixed phase is preferably less than 15% (including 0%). The average circle-equivalent diameter D of prior austenite grains is preferably 20 μm or less (not including 0 μm). The steel sheet, which is held in the temperature region satisfying Formula (2) and then cooled, may be subsequently subjected to electrogalvanizing, hot-dip galvanizing, or hot-dip galvannealing. Alternatively, the steel sheet may be subjected to hot-dip galvanizing or hot-dip galvannealing in the temperature region satisfying Formula (2).

In this description, "and/or" means that at least one is included.

Advantageous Effects of Invention

According to the present invention, the steel sheet is held at a temperature equal to or higher than the $Ac_3$ point for 50 sec or more so as to be soaked. Subsequently, the steel sheet is cooled into the low-temperature-side temperature region of 300° C. or higher and lower than 400° C. and held in the temperature region. Subsequently, the steel sheet is heated into the high-temperature-side temperature region of 400° C. or higher and 540° C. or lower and held in the temperature region. This makes it possible to shorten austempering treatment time compared with that in PTL 6. Consequently, productivity of the high-strength cold-rolled steel sheet can be improved. In addition, the high-strength cold-rolled steel sheet provided by the invention is excellent in composite workability as evaluated by Erichsen test in addition to elongation (EL), stretch-flangeability (λ), bendability (R), and balance of these properties (TS×EL×λ/1000).

DESCRIPTION OF EMBODIMENTS

Figure 1:
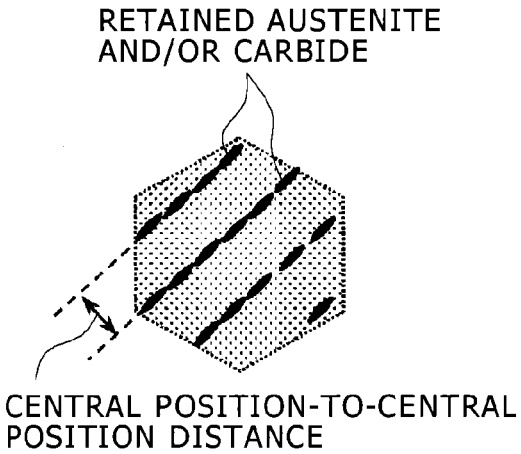
FIG. 1 is a schematic diagram illustrating an example of an average distance between adjacent retained-austenite grains and/or carbide particles.

The inventors have conducted earnest study on a method of manufacturing the high-strength cold-rolled steel sheet having excellent general workability proposed in PTL 6 in order to improve productivity of the steel sheet through improving the method. As a result, the inventors have got the following findings. That is, the steel sheet is held at a temperature equal to or higher than the $Ac_3$ point for 50 sec or more so as to be soaked. Subsequently, in PTL 6, the steel sheet is held in the high-temperature-side temperature region and then held in the low-temperature-side temperature region. In contrast, in the invention, the steel sheet is cooled to the low temperature and then held in such a low temperature region so that low-temperature-region-formed bainite and martensite are formed, and is then heated into the high-temperature-side temperature region and held therein to form the high-temperature-region-formed bainite, which allows the austempering treatment time to be shortened, leading to improvement in productivity. Thus, the inventors have completed the present invention. In addition, it has been confirmed that the high-strength cold-rolled steel sheet provided by the manufacturing method of the invention is also excellent in composite workability as evaluated by Erichsen test in addition to elongation (EL), stretch-flangeability (λ), bendability (R), and balance of these properties (TS×EL×λ/1000).

Specifically, in PTL 6, the steel sheet is held for 50 sec or more at a temperature equal to or higher than the $Ac_3$ point for soaking. Subsequently, the steel sheet is held in the high-temperature-side temperature region of 400° C. or higher and 540° C. or lower, and is then held in the low-temperature-side temperature region of 200° C. or higher and lower than 400° C. so as to be subjected to austempering treatment. The austempering treatment temperature is therefore low, and long time is taken for formation of the low-temperature-region-formed bainite, etc. and for thickening of carbon; hence, at least 200 sec is necessary as time for the austempering treatment.

In contrast, in the invention, the steel sheet is held at a temperature equal to or higher than the $Ac_3$ point for 50 sec or more so as to be soaked. Subsequently, the steel sheet is cooled into the low-temperature-side temperature region of 300° C. or higher and lower than 400° C. to form martensite, and held in the temperature region to form the low-temperature-region-formed bainite. Subsequently, the steel sheet is heated into the high-temperature-side temperature region of 400° C. or higher and 540° C. or lower and held in the temperature region so as to be subjected to austempering treatment, and thereby austenite that has been not transformed in the low-temperature-side temperature region is transformed to form the high-temperature-region-formed bainite. At this time, since the austempering treatment temperature is higher than that in PTL 6, carbon is easily thickened, and retained austenite (which may be represented as retained γ below) can be promptly formed. In addition, the steel sheet is heated into the high-temperature-side temperature region and subjected to austempering treatment, and thereby martensite, which has been formed during cooling into the low-temperature-side temperature region after the soaking, is tempered into tempered martensite.

In this way, according to the invention, the steel sheet is held in the low-temperature-side temperature region, and is then heated and subjected to austempering treatment in the high-temperature-side temperature region, which also allows bainite to be formed into a composite structure of the high-temperature-region-formed bainite and the low-temperature-region-formed bainite, etc. In addition, each of the low-temperature-region-formed bainite and the martensite, which are formed through quickly cooling the steel sheet into the low-temperature-side temperature region and holding the steel sheet in the low-temperature-side temperature region, further has a function of promoting transformation of untransformed austenite into the high-temperature-region-formed bainite during the austempering treatment performed in the high-temperature-side temperature region. Hence, the steel sheet is held in the low-temperature-side temperature region and then held in the high-temperature-side temperature region, and thereby formation of the high-temperature-region-formed bainite and keeping of the retained γ can be performed in a short time. As a result, according to the invention, since the austempering treatment time can be shortened compared with that in PTL 6, productivity of the high-strength cold-rolled steel sheet can be improved.

In addition, the high-strength cold-rolled steel sheet of the invention is improved in composite workability as evaluated by Erichsen test in addition to elongation (EL), stretch-flangeability (λ), bendability (R), and balance of these properties (TS×EL×λ/1000).

Furthermore, according to the invention, the steel sheet is cooled into the low-temperature-side temperature region after soaking, and therethrough martensite and the low-temperature-region-formed bainite are formed; hence, untransformed austenite is fragmented, and thickening of carbon into the untransformed austenite is appropriately suppressed. As a result, the MA phase is refined, and void formation can be suppressed.

The high-strength cold-rolled steel sheet that can be manufactured by the invention is now described. The high-strength cold-rolled steel sheet basically has the same constituent composition and the same microstructure as those in PTL 6.

<Constituent Composition>

[C: 0.10 to 0.3%]

C is an element necessary for increasing strength of a steel sheet and for forming retained γ. Hence, the C content is defined to be 0.10% or more, preferably 0.11% or more, and more preferably 0.13% or more. However, if C is excessively contained, weldability is degraded. Hence, the C content is defined to be 0.3% or less, preferably 0.25% or less, and more preferably 0.20% or less.

[Si: 1.0 to 3%]

Si is an extremely important element that contributes to increasing strength of a steel sheet as a solution strengthening element, and suppresses precipitation of carbide during holding of the steel sheet in the T1 temperature region and the T2 temperature region (during the austempering treatment) to effectively form retained γ. Consequently, the Si content is defined to be 1.0% or more, preferably 1.2% or more, and more preferably 1.4% or more. However, if Si is excessively contained, a γ single phase cannot be secured and ferrite remains during heating and soaking in annealing; hence, formation of each of the high-temperature-region-formed bainite and the low-temperature-region-formed bainite, etc. is suppressed. In addition, strength becomes excessively high and thus a rolling load increases, and Si scales are produced on a steel sheet surface during hot rolling, which worsens a surface texture of the steel sheet. Hence, the Si content is defined to be 3% or less, preferably 2.5% or less, and more preferably 2.0% or less.

[Mn: 1.5 to 3%]

Mn is an element necessary for increasing hardenability to suppress formation of ferrite during cooling and produce bainite and tempered martensite. In addition, Mn is an element that effectively functions to stabilize γ so that the retained γ is formed. Hence, the Mn content is defined to be 1.5% or more, preferably 1.8% or more, and more preferably 2.0% or more. However, if Mn is excessively contained, formation of the high-temperature-region-formed bainite is extremely suppressed. On the other hand, an excessively high content of Mn causes degradation of weldability and degradation of workability due to segregation. Hence, the Mn content is defined to be 3% or less, preferably 2.8% or less, and more preferably 2.6% or less.

[Al: 0.005 to 3%]

Al is an element that contributes to suppressing precipitation of carbide during holding of the steel sheet in the T1 temperature region and the T2 temperature region (during the austempering treatment), as with Si. In addition, Al is an element that functions as a deoxidizer. Hence, the Al content is defined to be 0.005% or more, preferably 0.01% or more, and more preferably 0.03% or more. However, if Al is excessively contained, weldability of a steel sheet is extremely degraded; hence, the Al content must be the minimum necessary for deoxidization. Hence, the Al content is defined to be 3% or less, preferably 2% or less, and more preferably 1% or less.

[P: 0.1% or less (not including 0%)]

P is an element that degrades weldability of a steel sheet. Hence, the P content is defined to be 0.1% or less, preferably 0.08% or less, and more preferably 0.05% or less. The P content is preferably as small as possible, but is industrially difficult to be decreased to 0%.

[S: 0.05% or less (not including 0%)]

S is an element that degrades weldability of a steel sheet, as with P. In addition, S forms sulfide-based inclusions in steel, and if such inclusions are coarsened, workability is degraded. Hence, the S content is defined to be 0.05% or less, preferably 0.01% or less, and more preferably 0.005% or less. The S content is preferably as small as possible, but is industrially difficult to be decreased to 0%.

The high-strength cold-rolled steel sheet of the invention satisfies the above-described constituent composition, while the remainder substantially consists of iron and inevitable impurities. Examples of the inevitable impurities include N, O, and tramp elements (for example, Pb, Bi, Sb, and Sn). In the inevitable impurities, the N content is preferably 0.01% or less (not including 0%), and the O content is preferably 0.01% or less (not including 0%).

N is an element that contributes to strengthening of a steel sheet through precipitating nitride in steel, but, if N is excessively contained, a large amount of nitride is precipitated, causing degradation of each of elongation, stretch-flangeability, and bendability. Hence, the N content is preferably 0.01% or less. The N content is more preferably 0.008% or less, and most preferably 0.005% or less.

O is an element that causes, when excessively contained, degradation of each of elongation, stretch-flangeability, and bendability through precipitation of a large amount of oxide. Hence, the O content is preferably 0.01% or less. The O content is more preferably 0.005% or less, and most preferably 0.003% or less.

The high-strength cold-rolled steel sheet of the invention may further contain other elements including (a) Cr: 1% or less (not including 0%) and/or Mo: 1% or less (not including 0%),
(b) at least one element selected from the group consisting of Ti: 0.15% or less (not including 0%), Nb: 0.15% or less (not including 0%), and V: 0.15% or less (not including 0%),
(c) Cu: 1% or less (not including 0%) and/or Ni: 1% or less (not including 0%),
(d) B: 0.005% or less (not including 0%), and
(e) at least one element selected from the group consisting of Ca: 0.01% or less (not including 0%), Mg: 0.01% or less (not including 0%), and rare earth elements: 0.01% or less (not including 0%).

(a) Cr and Mo, as with Mn, are each an element that effectively functions to suppress formation of ferrite during cooling so that bainite and tempered martensite are produced. Such elements may each be used singly, or may be used together. To allow Cr and Mo to effectively exhibit such a function, each of Cr and Mo is preferably contained 0.1% or more. More preferably, the content is 0.2% or more. However, if the content of each of Cr and Mo exceeds 1%, formation of the high-temperature-region-formed bainite is extremely suppressed. Moreover, such an excessively large content leads to cost increase. Hence, the content of each of Cr and Mo is preferably 1% or less, more preferably 0.8% or less, and most preferably 0.5% or less. When Cr and Mo are used together, the total content is recommended to be 1.5% or less.

(b) Ti, Nb, and V are each an element that has a function of forming precipitates of carbide, nitride, etc. to strengthen the steel and refine prior γ grains. To allow Ti, Nb, and V to effectively exhibit such a function, each of Ti, Nb, and V is preferably contained 0.01% or more. More preferably, the content is 0.02% or more. However, if each of such elements is excessively contained, carbide is precipitated in grain boundaries, resulting in degradation of stretch-flangeability and bendability of a steel sheet. Hence, the content of each of Ti, Nb, and V is preferably 0.15% or less. The content thereof is more preferably 0.12% or less and most preferably 0.1% or less. Ti, Nb, and V may each be contained singly. Alternatively, at least two of them may be appropriately selected and contained together.

(c) Cu and Ni are each an element that effectively functions to stabilize γ so that the retained γ is formed. Such elements may each be used singly, or may be used together. To allow Cu and Ni to effectively exhibit such a function, each of Cu and Ni is preferably contained 0.05% or more. More preferably, the content is 0.1% or more. However, if each of Cu and Ni is excessively contained, hot workability is degraded. Hence, the content of each of Cu and Ni is preferably 1% or less. The content is more preferably 0.8% or less and most preferably 0.5% or less. Although the Cu content of more than 1% leads to degradation of hot workability, if Ni is further contained, such degradation of hot workability is suppressed. Hence, when Cu and Ni are contained together, Cu may be contained more than 1% though cost increases.

(d) B is an element that effectively functions to suppress formation of ferrite during cooling so that bainite and tempered martensite are formed, as with Mn, Cr, and Mo. To allow B to effectively exhibit such a function, B is preferably contained 0.0005% or more, and more preferably 0.001% or more. However, if B is excessively contained, bolide is formed and ductility is degraded. In addition, if B is excessively contained, formation of the high-temperature-region-formed bainite is extremely suppressed, as with Cr and Mo. Hence, the B content is preferably 0.005% or less, more preferably 0.004% or less, and most preferably 0.003% or less.

(e) Ca, Mg, and rare earth elements (REM) are each an element that functions to finely disperse inclusions in a steel sheet. To allow Ca, Mg, and rare earth elements to effectively exhibit such a function, each of Ca, Mg, and rare earth elements is preferably contained 0.0005% or more. More preferably, each of such elements is contained 0.001% or more. However, if each of such elements is excessively contained, casting performance, hot workability, and the like are degraded, and manufacturing of a steel sheet becomes difficult. Moreover, an excessively large content of each of such elements causes degradation of ductility of a steel sheet. Hence, the content of each of Ca, Mg, and rare earth elements is preferably 0.01% or less, more preferably 0.005% or less, and most preferably 0.003% or less.

The rare earth elements mean elements including lanthanoid elements (15 elements from La to Lu), Sc (scandium), and Y (yttrium). Among such elements, at least one element selected from the group consisting of La, Ce, and Y is preferably contained. More preferably, La and/or Ce are contained.

<Microstructure>

The microstructure of the high-strength cold-rolled steel sheet according to the invention is composed of a mixed structure of bainite, retained γ, and tempered martensite.

[Bainite and Tempered Martensite]

First, bainite in the microstructure is described. In the present invention, bainite is a main phase (parent phase) that accounts for 70% or more in area of the total microstructure. The bainite also includes bainitic ferrite. Bainite is a phase including precipitated carbide, while bainitic ferrite is a phase including no precipitated carbide. In the invention, the area fraction of the bainite includes area of tempered martensite as described later.

The invention is characterized in that the bainite is composed of a composite structure of the high-temperature-region-formed bainite and the low-temperature-region-formed bainite having higher strength than the high-temperature-region-formed bainite. In the invention, the bainite is composed of the two types of bainite phases. This makes it possible to further increase elongation while excellent stretch-flangeability and bendability are maintained, leading to improvement in general workability. This is possibly because the bainite phases having different strength levels are compounded with each other, which causes nonuniform deformation, and therefore work hardenability is enhanced.

In the invention, the high-temperature-region-formed bainite is a bainite phase formed in the T2 temperature region of 400° C. or higher and 540° C. or lower, and means bainite in which, when a nital-etched steel sheet section is observed under a scanning electron microscope (SEM), an average distance of the retained γ or the like is 1 μm or more.

On the other hand, in the invention, the low-temperature-region-formed bainite is a bainite phase formed in the T1 temperature region of 300° C. or higher and lower than 400° C., and means bainite in which, when a nital-etched steel sheet section is observed under a SEM, an average distance of the retained γ or the like is less than 1 μm. The low-temperature-region-formed bainite cannot be distinguished from the tempered martensite even by microscopic observation. In addition, the low-temperature-region-formed bainite and the tempered martensite have influence on steel properties at substantially the same level. In the invention, therefore, the low-temperature-region-formed bainite and the tempered martensite may be collectively referred to as "low-temperature-region-formed bainite, etc."

The term "average distance of retained γ or the like" means, when a steel sheet section is observed under a microscope, an averaged value of measurement results of central position-to-central position distances between adjacent retained γ grains, of central position-to-central position distances between adjacent carbide particles, or of central position-to-central position distances between adjacent retained γ grains and carbide particles. The central position-to-central position distance means a distance between obtained central positions of individual retained γ grains or between obtained central positions of individual carbide particles. The central position is defined to be a position at which the major axis intersects with the minor axis, the major axis and the minor axis being determined for each of the retained γ grains or each of the carbide particles. However, in the case where the retained γ or the carbide is precipitated on a boundary of a lath, a plurality of retained γ grains and carbide particles stretch into a needle shape or a sheet shape. Hence, the central position-to-central position distance should be determined as an interval (lath-to-lath distance) between lines formed by the retained γ grains and/or the carbide particles stretching in a major-axis direction as illustrated in FIG. 1, instead of the distance between the retained γ grains and/or the carbide particles.

In the invention, a composite bainite phase including the high-temperature-region-formed bainite and the low-temperature-region-formed bainite, etc. is given, and thereby it is possible to achieve a high-strength cold-rolled steel sheet improved in general workability. Specifically, the high-temperature-region-formed bainite is softer than the low-temperature-region-formed bainite, and therefore functions to increase elongation of a steel sheet and contributes to improve workability. On the other hand, the low-temperature-region-formed bainite, etc. has small size of carbide and small size of retained γ, and is thus reduced in stress concentration during deformation, and therefore has a function of improving stretch-flangeability and bendability of a steel sheet, and consequently contributes to improve workability. In the invention, such high-temperature-region-formed bainite and low-temperature-region-formed bainite, etc. are compound with each other; hence, work hardenability is improved, elongation is further increased, and workability is improved.

The reason why bainite is classified, in the invention, into "high-temperature-region-formed bainite" and "low-temperature-region-formed bainite, etc." depending on a difference in formation temperature region and on a difference in average distance of retained γ or the like is because bainite is difficult to be clearly classified by typical scholarly structure classification. For example, lath-shaped bainite and bainitic ferrite are each in general classified into upper bainite and lower bainite depending on transformation temperature. Through SEM observation, however, precipitation of carbide along with bainite transformation is suppressed in a steel type containing a large amount of Si. Hence, it is difficult to distinguish between such types of bainite as well as a martensite phase. In the invention, therefore, bainite is classified as described above instead of being classified according to scholarly structure definition.

The high-temperature-region-formed bainite and the low-temperature-region-formed bainite, etc. may be distributed in any manner without limitation. Both the high-temperature-region-formed bainite and the low-temperature-region-formed bainite, etc. may mixedly exist in each prior γ grain. Alternatively, the high-temperature-region-formed bainite and the low-temperature-region-formed bainite, etc. may separately exist in the individual prior γ grains.

Figure 2:
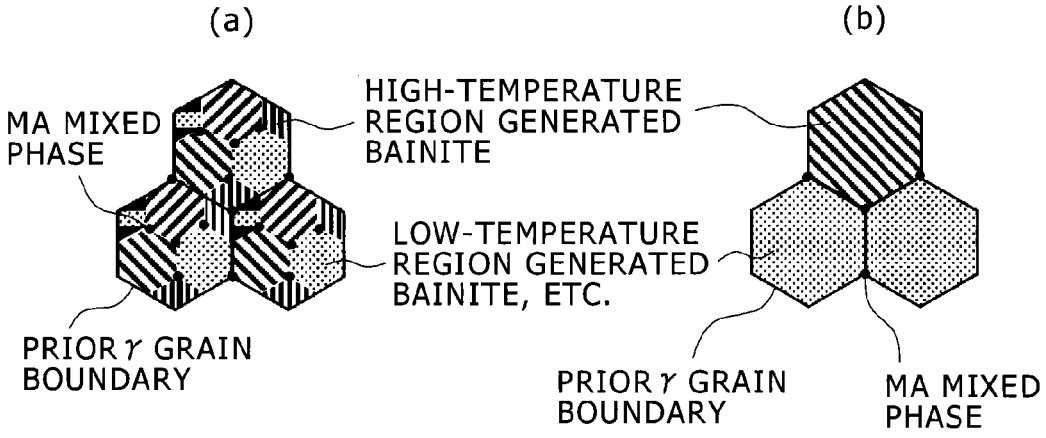
FIG. 2 includes diagrams schematically illustrating a distribution state of each of high-temperature-region-formed bainite and low-temperature-region-formed bainite, etc. (low-temperature-region-formed bainite and tempered martensite).

FIG. 2 includes diagrams schematically illustrating a distribution state of each of the high-temperature-region-formed bainite and the low-temperature-region-formed bainite, etc. FIG. 2(*a*) illustrates an aspect where both of the high-temperature-region-formed bainite and the low-temperature-region-formed bainite, etc. mixedly exist in a prior γ grain. FIG. 2(*b*) illustrates an aspect where the high-temperature-region-formed bainite and the low-temperature-region-formed bainite, etc. separately exist in the individual prior γ grains. Each black circle illustrated in FIG. 2 indicates a MA mixed phase. The MA mixed phase is described later.

In the invention, when an area fraction of the high-temperature-region-formed bainite in the entire microstructure is denoted as "a", and when a total area fraction of the low-temperature-region-formed bainite and the tempered martensite (i.e., the low-temperature-region-formed bainite, etc.) in the entire microstructure is denoted as "b", each of a and b must satisfy 20 to 80%.

If the area fraction a of the high-temperature-region-formed bainite or the total area fraction b of the low-temperature-region-formed bainite, etc. is below 20% or over 80%, production balance between the high-temperature-region-formed bainite and the low-temperature-region-formed bainite, etc. becomes bad, and the effect due to the complex of the high-temperature-region-formed bainite and the low-temperature-region-formed bainite, etc. is not exhibited. As a result, one of the properties of elongation, stretch-flangeability, and bendability is degraded, and general workability cannot be improved. Hence, the area fraction a is defined to be 20 to 80%, preferably 25 to 75%, and more preferably 30 to 70%. The area fraction b is defined to be 20 to 80%, preferably 25 to 75%, and more preferably 30 to 70%.

The relationship between the a and the b may be any relationship without limitation as long as each range satisfies the above-described range, i.e., may include any of modes of a>b, a<b, and a=b.

A mixing ratio of the high-temperature-region-formed bainite and the low-temperature-region-formed bainite, etc. should be determined in accordance with properties required for a cold-rolled steel sheet. Specifically, a proportion of the high-temperature-region-formed bainite is decreased while a proportion of the low-temperature-region-formed bainite, etc. is increased in order to improve stretch-flangeability in workability of a cold-rolled steel sheet. On the other hand, the proportion of the high-temperature-region-formed bainite is increased while the proportion of the low-temperature-region-formed bainite, etc. is decreased in order to improve elongation in workability of a cold-rolled steel sheet. Furthermore, the proportion of the low-temperature-region-formed bainite, etc. is increased while the proportion of the high-temperature-region-formed bainite is decreased in order to increase strength of a cold-rolled steel sheet.

Furthermore, in the invention, the sum (a+b) of the area fraction a and the total area fraction b must satisfy 70% or more with respect to the entire microstructure. If the sum (a+b) is below 70%, the tensile strength of at least 980 MPa cannot be achieved. Hence, the sum (a+b) is 70% or more, preferably 75% or more, and more preferably 80% or more. The upper limit of the sum (a+b) is, but not limited to, 95%, for example.

[Retained γ]

The high-strength cold-rolled steel sheet of the invention includes the retained γ in addition to the high-temperature-region-formed bainite, the low-temperature-region-formed bainite, and the tempered martensite. The retained γ is a phase that is transformed into martensite when a steel sheet undergoes strain and deforms, and thus exhibits large elongation, and exhibits an effect of prompting hardening of a deformed portion and preventing strain concentration. Such an effect is in general referred to as TRIP effect. To allow the retained γ to exhibit such an effect, the retained γ must be contained 3% or more in volume, preferably 5% or more in volume, and more preferably 7% or more in volume, where such a fraction of that retained γ in the entire microstructure is determined by saturation magnetization measurement. However, when the fraction of the retained γ becomes excessively high, the MA mixed phase described later is formed. The MA mixed phase is easily coarsened, and degrades the stretch-flangeability and the bendability. Hence, the upper limit of the fraction of the retained γ is about 20% in volume.

Although retained γ is largely formed between lathes of a microstructure, the retained γ may massively exist as a part of the MA mixed phase described later on an aggregate (for example, a block or a packet) of lath-shaped phases or a grain boundary of prior γ.

[Others]

As described above, the microstructure of the high-strength cold-rolled steel sheet according to the invention includes bainite, retained γ, and tempered martensite, while a microstructure of the remainder is not limited. For example, although the microstructure may be composed of such structures, the microstructure may have (a) the MA mixed phase including quenched martensite compound with retained γ, (b) soft polygonal ferrite, (c) perlite, or the like within a range without impairing the effects of the invention.

(a) MA Mixed Phase

To describe the MA mixed phase, the MA mixed phase is typically known as a composite phase of quenched martensite and retained γ, and is formed in such a manner that part of a phase, which has existed as untransformed austenite before final cooling, is transformed into martensite during final cooling, and the remainder remains as austenite. The MA mixed phase formed in this way is an extremely hard phase since carbon is thickened at high concentration during a step of heat treatment (particularly austempering treatment), and the martensite phase partially exists. This results in a large hardness difference between the parent phase composed of bainite and the MA mixed phase, and thus an origin of void formation is easily formed due to stress concentration during deformation. Hence, if the MA mixed phase is excessively formed, local deformability is degraded, and consequently stretch-flangeability and bendability are degraded. Moreover, if the MA mixed phase is excessively formed, strength tends to be excessively higher. While the MA mixed phase is more easily formed with an increase in amount of retained γ or with an increase in Si content, production of the MA mixed phase is preferably as small as possible.

In the high-strength cold-rolled steel sheet of the invention, as described above, since a relatively high concentration of Si is contained, the MA mixed phase is easily formed. When the MA mixed phase exists, an area fraction thereof, which is determined through optical microscopic observation, in the entire microstructure is preferably 30% or less, more preferably 25% or less, and most preferably 20% or less.

In grains of the MA mixed phase, some grains, each having a circle-equivalent diameter d of more than 3 μm on a viewing section, preferably have a number ratio of less than 15% (including 0%) in the total number of grains of the MA mixed phase. It has been experimentally found that as grain size of the MA mixed phase increases, voids tend to be easily formed; hence, the grain size of the MA mixed phase is preferably as small as possible. The number ratio of grains of the MA mixed phase, each grain having a circle-equivalent diameter d of more than 3 μm on a viewing section, is more preferably less than 10%, and most preferably less than 5%. The number ratio of grains of the MA mixed phase, each grain having a circle-equivalent diameter d of more than 3 μm, can be calculated through optical microscopic observation of a sectional surface parallel to a rolling direction.

(b, c) Polygonal Ferrite, Perlite

When soft polygonal ferrite and/or perlite exist, the total area fraction of such phases is preferably 20% or less of area of the entire microstructure.

The microstructure can be determined according to the following procedure.

The high-temperature-region-formed bainite, the low-temperature-region-formed bainite, etc., polygonal ferrite, and perlite can each be identified through observation, under a SEM of 3000 magnifications, of a ¼ thickness position on a section parallel to a rolling direction of a steel sheet. In the SEM observation, the high-temperature-region-formed bainite and the low-temperature-region-formed bainite, etc. are largely observed gray, and are each observed as a phase where white or gray grains of retained γ or the like are dispersed in a crystal grain. The polygonal ferrite is observed as a crystal grain in which the above-described white or gray grains of retained γ or the like are not contained. The perlite is observed as a phase including carbide and ferrite in a lamellar form. On the other hand, the MA mixed phase is observed as a white phase through optical microscopic observation of a specimen subjected to Repera etching.

The high-temperature-region-formed bainite and the low-temperature-region-formed bainite, etc. can each be identified in such a manner that a section parallel to a rolling direction of a steel sheet is nital-etched, and a ¼ thickness position is observed under a SEM of about 3000 magnifications. When a section of a steel sheet is nital-etched, carbide and retained γ are each observed as a white or gray phase, and are different to be distinguished from each other. Among them, carbide (for example, cementite) tends to be more precipitated in an inner-lath space than in an inter-lath space as it is formed in a lower temperature region. Hence, in the case of a large distance between carbide particles, the carbide is considered to be formed in a high temperature region. In the case of a small distance between carbide particles, the carbide is considered to be formed in a low temperature region. While retained γ is typically formed in an inter-lath space, the lath size becomes smaller as the phase formation temperature is lower. Hence, the retained γ is considered to be formed in a high temperature region in the case of a large distance between grains of the retained γ while being considered to be formed in a low temperature region in the case of a small distance between grains of the retained γ. In the invention, therefore, SEM observation is performed on a nital-etched section, and a phase that is observed white or gray in a viewing field is focused and central position-to-central position distances of adjacent grains of the phase are measured. A phase having an average (average distance) of the measured distances of 1 μm or more is defined to be the high-temperature-region-formed bainite, and a phase having the average distance of less than 1 μm is defined to be the low-temperature-region-formed bainite, etc. The central position-to-central position distances of the phase grains should be measured on most adjacent phase grains.

The high-temperature-region-formed bainite and the low-temperature-region-formed bainite, etc. obtained through such SEM observation each include retained γ and carbide. Hence, an area fraction of each bainite is calculated as area fraction of bainite with retained γ.

In contrast, a phase of retained γ cannot be identified by SEM observation, and therefore a volume fraction of the retained γ is measured by saturation magnetization measurement. A value of the volume fraction can be directly read as area fraction. Detailed measurement principle with the saturation magnetization measurement can be found in "Research and Development KOBE STEEL ENGINEERING REPORTS, Vol. 52, No. 3, 2002, pp. 43 to 46".

For the MA mixed phase, a section parallel to a rolling direction of a steel sheet is Repera-etched, and a ¼ thickness position is observed under a light microscope of about 1000 magnifications. As a result, the MA mixed phase can be observed as a white phase that is distinguishable from other phases. An area fraction of the MA mixed phase can be determined through image analysis of such a photomicrograph.

In this way, while the volume fraction (area fraction) of retained γ is determined by saturation magnetization measurement, the area fraction of each of the high-temperature-region-formed bainite, the low-temperature-region-formed bainite, etc., polygonal ferrite, and perlite is determined through SEM observation, and the MA mixed phase is determined together with retained γ through light microscope observation. As a result, the sum of such area fractions may exceed 100%.

In the cold-rolled steel sheet of the invention, the average circle-equivalent diameter D of the prior γ grains is preferably 20 μm or less (not including 0 μm). Decreasing the average circle-equivalent diameter D of the prior γ grains makes it possible to further improve all of elongation, stretch-flangeability, and bendability.

Specifically, since the microstructure of the cold-rolled steel sheet of the invention is composed of a mixed structure of bainite, retained γ, and tempered martensite, if grain size of untransformed austenite is large, size of a composite unit of the bainite phase becomes large and phase size is varied, which leads to nonuniform deformation and local strain concentration, and consequently workability is difficult to be improved. It is therefore effective that the average circle-equivalent diameter D of the prior γ grains is controlled to be 20 μm or less to reduce macroscopic non-uniformity in order of several tens of micrometers. The average circle-equivalent diameter D of the prior γ grains is more preferably 15 μm or less, and most preferably 10 μm or less.

The average circle-equivalent diameter D of the prior γ grains can be determined by a SEM-EBSP method using SEM and electron backscatter diffraction (EBSP) in combination. Specifically, crystal orientation is measured by the SEM-EBSP method in 0.1 μm steps over a range of an observation field of about 100 μm×100 μm, and then a crystal orientation relationship between adjacent measurement points is analyzed, thereby the prior γ grain boundary can be specified. The average circle-equivalent diameter D of the prior γ grains should be calculated by a comparison method based on the specified prior γ grain boundary. A detailed measurement principle by the SEM-EBSP method can be found in "Acta Materialia, 54, 2006, pp. 1279 to 1288".

A method of manufacturing the high-strength cold-rolled steel sheet according to the invention is now described.

The high-strength cold-rolled steel sheet of the invention is characterized in that the steel satisfying the above-described constituent composition is held for 50 sec or more at a temperature equal to or higher than the $Ac_3$ point so as to be soaked, and is then cooled to an appropriate temperature T satisfying Formula (1) at an average cooling rate of 15° C./sec or higher and is held for 5 to 180 sec in a temperature region satisfying Formula (1), and is then heated into a temperature region satisfying Formula (2) and held in the temperature region for 50 sec or more, and is then cooled. The manufacturing method of the invention is sequentially described.

$$300° \text{ C.} \leq T1(° \text{ C.}) < 400° \text{ C.} \quad (1)$$

$$400° \text{ C.} \leq T2(° \text{ C.}) \leq 540° \text{ C.} \quad (2)$$

First, a slab, as steel before being heated at a temperature equal to or higher than the $Ac_3$ point, is hot-rolled in a usual manner, and the resultant hot-rolled steel sheet is cold-rolled to prepare a cold-rolled steel sheet. In the hot rolling, finish rolling temperature is, for example, 800° C. or higher, and winding temperature is, for example, 700° C. or lower. The cold rolling may be performed with cold-rolling reduction ranging from 10% to 70%, for example.

The cold-rolled steel sheet produced through the cold rolling is heated to a temperature equal to or higher than the $Ac_3$ point in a continuous annealing line, and is held in such a temperature region for 50 sec or more so as to be soaked and thus formed into a γ single phase. If the soaking temperature is below the $Ac_3$ point, or if the soaking time in the temperature region at or above the $Ac_3$ point is below 50 sec, ferrite remains in austenite, and the sum (a+b) of the area fraction a of the high-temperature-region-formed bainite and the total area fraction b of the low-temperature-region-formed bainite, etc. cannot be adjusted to a predetermined value or more. The soaking temperature is preferably equal to or higher than $Ac_3$ point+10° C., and more preferably equal to or higher than $Ac_3$ point+20° C. However, even if the soaking temperature is excessively increased, the sum (a+b) is not significantly varied, leading to economically waste. Hence, the upper limit of the soaking temperature is defined to be 1000° C., for example.

The soaking time is preferably 100 sec or more. However, excessively long soaking time results in large grain size of austenite, and tends to degrade workability. Hence, the soaking time is preferably 500 sec or less.

In heating of the cold-rolled steel to the temperature equal to or higher than the $Ac_3$ point, the average heating rate should be 1° C./sec or higher.

The $Ac_3$ point can be calculated by Formula (a) described in "The Physical Metallurgy of Steels, William C. Leslie" (Maruzen Company, Limited, issued on May 31, 1985, p. 273). In Formula (a), each bracket indicates the content (by mass percent) of each element. Calculation should be made assuming that the content of an element that is not contained in a steel sheet is 0 mass percent.

$$Ac_3(°\ C.)=910-203\times[C]^{1/2}+44.7\times[Si]-30\times[Mn]-11\times[Cr]+31.5\times[Mo]-20\times[Cu]-15.2\times[Ni]+400\times[Ti]+104\times[V]+700\times[P]+400\times[Al] \quad (a)$$

Figure 3:
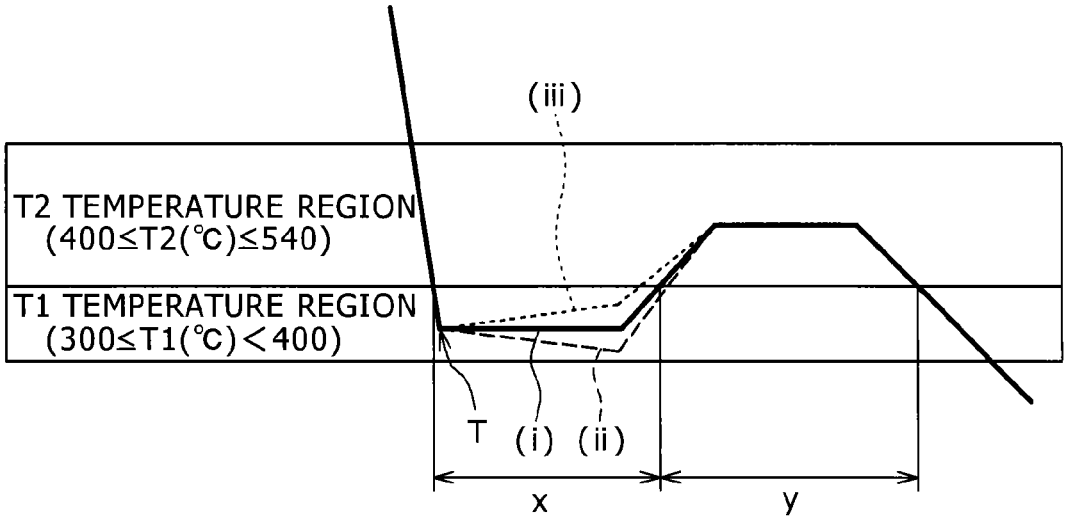
FIG. 3 is a schematic diagram illustrating an example of a heat pattern in each of the T1 temperature region and the T2 temperature region.

The steel sheet is heated and held for 50 sec or more at the temperature equal to or higher than the $Ac_3$ point so as to be soaked. After that, as illustrated in FIG. 3, the steel sheet is rapidly cooled to an appropriate temperature T satisfying Formula (1) at an average cooling rate of 15° C./sec or higher. The steel sheet is rapidly cooled over a range from the temperature region at or above the $Ac_3$ point to the appropriate temperature T satisfying Formula (1), which suppresses transformation of austenite into polygonal ferrite, and makes it possible to form a predetermined amount of low-temperature-region-formed bainite and a predetermined amount of martensite. The average cooling rate in the temperature range is preferably 20° C./sec or higher, and more preferably 25° C./sec or higher. The upper limit of the average cooling rate should be, but not limited to, about 100° C./sec, for example.

The steel sheet is cooled to the appropriate temperature T satisfying Formula (1). After that, as illustrated in FIG. 3, the steel sheet is held for 5 to 180 sec in a T1 temperature region satisfying Formula (1), and then heated into a T2 temperature region satisfying Formula (2) and held in the T2 temperature region for 50 sec or more.

In the invention, holding time x in the T1 temperature region means a period from a time point, at which surface temperature of the steel sheet is decreased to lower than 400° C. after the steel sheet is soaked at the temperature equal to or higher than the $Ac_3$ point, to a time point, at which the surface temperature of the steel sheet reaches 400° C. after the steel sheet is held in the T1 temperature region and then heated. That is, the holding time x means a time span indicated by an arrow x in FIG. 3. Hence, in the invention, since the steel sheet is held in the T2 temperature region and then cooled to room temperature as described later, the steel sheet experiences the T1 temperature region again. In the invention, however, such experience time during the cooling is not included in the residence time in the T1 temperature region. This is because the low-temperature-region-formed bainite is not formed since transformation is substantially completed before such cooling.

Holding time y in the T2 temperature region means a period from a time point, at which the surface temperature of the steel sheet reaches 400° C. after the steel sheet is held in the T1 temperature region and then heated, to a time point, at which the surface temperature of the steel sheet reaches 400° C. after the steel sheet is held in the T2 temperature region and then cooled. That is, the holding time y is a time span indicated by an arrow γ in FIG. 3. Hence, in the invention, the steel sheet experiences the T2 temperature region during cooling into the T1 temperature region after soaking as described above. In the invention, however, such experience time during the cooling is not included in the residence time in the T2 temperature region. This is because since the experience time is extremely short, transformation does substantially not occur, and the high-temperature-region-formed bainite is not formed.

In the invention, the holding time in each of the T1 temperature region and the T2 temperature region is appropriately controlled, thereby a predetermined amount of high-temperature-region-formed bainite can be formed. Specifically, the steel sheet is held in the T1 temperature region for a predetermined time, and thereby untransformed austenite is transformed into the low-temperature-region-formed bainite, bainitic ferrite, or martensite, and the steel sheet is held in the T2 temperature region for a predetermined time so as to be subjected to austempering treatment, and thereby the untransformed austenite is further transformed into the high-temperature-region-formed bainite and bainitic ferrite. In addition, production of each of such phases is controlled, and carbon is thickened into austenite to form retained γ, so that the microstructure defined in the invention can be formed.

Furthermore, the steel sheet is held in the T1 temperature region and then held in the T2 temperature region, which allows the effect of refining the MA mixed phase to be exhibited. Specifically, the steel sheet is soaked at the temperature equal to or higher than the $Ac_3$ point, and is then rapidly cooled to the appropriate temperature T in the T1 temperature region at an average cooling rate of 15° C./sec or higher, and is held in the T1 temperature region, and thereby martensite and the low-temperature-region-formed bainite are formed. Consequently, an untransformed portion is refined, and thickening of carbon into the untransformed portion is appropriately suppressed, and therefore the MA mixed phase is refined.

Even if the steel sheet is cooled to an appropriate temperature T satisfying Formula (1) from the temperature region at or above the $Ac_3$ point, and is held in the T1 temperature region satisfying Formula (1) without being heated into the T2 temperature region satisfying Formula (2) and without being held therein (i.e., simple austempering treatment by low-temperature holding), since size of each lath-shaped phase is reduced, the MA mixed phase itself can be reduced in size. In this case, however, since the steel sheet is not held in the T2 temperature region, the high-temperature-region-formed bainite is substantially not formed, and dislocation density of the matrix lath-shaped phase is increased, leading to excessively high strength and decreased elongation.

In the invention, the T1 temperature region defined in Formula (1) is specifically 300° C. or higher and lower than 400° C. Holding the steel sheet for a predetermined time in this temperature region allows the untransformed austenite to be transformed into the low-temperature-region-formed bainite, bainitic ferrite, or martensite. Moreover, sufficient holding time is ensured, which accelerates bainite transformation, and finally retained γ is formed, and the MA mixed phase is fragmented. This martensite exists in a form of quenched martensite immediately after transformation. However, the martensite is tempered during holding in the T2 temperature region described later, and remains in a form of tempered martensite. This tempered martensite has no bad influence on any of elongation, stretch-flangeability, and bendability of the steel sheet.

If the steel sheet is held at 400° C. or higher, the low-temperature-region-formed bainite and martensite are not formed, so that the composite bainite phase cannot be produced. Moreover, a coarse MA mixed phase is formed and therefore the MA mixed phase cannot be refined. Hence, local deformability is degraded, and stretch-flangeability and bendability cannot be improved. Hence, the T1 temperature region is defined to be lower than 400° C. The T1 temperature region is preferably 390° C. or lower, more preferably 380° C. or lower, and most preferably 375° C. or lower. On the other hand, if the steel sheet is held at lower than 300° C., a martensite fraction becomes excessively large; hence, composite workability as evaluated by Erichsen test is degraded. In addition, if the steel sheet is held at lower than 300° C., the low-temperature-region-formed bainite is formed, but the martensite fraction becomes excessively large as described above, and a fraction of the low-temperature-region-formed bainite, etc. increases. As a result, composite workability as evaluated by Erichsen test is degraded. Hence, the lower limit of the T1 temperature region is defined to be 300° C. The lower limit is preferably 310° C. or higher, and more preferably 320° C. or higher.

To form the low-temperature-region-formed bainite, etc., the steel sheet is held in the temperature region of 300° C. or higher and lower than 400° C. in the invention, while the steel sheet is held in the temperature region of 200° C. or higher and lower than 400° C. in PTL 6, showing a different lower limit value of the temperature region. The reason for this is as follows. That is, in the invention, the steel sheet is soaked at a temperature equal to or higher than the $Ac_3$ point, and is then rapidly cooled into the low-temperature-side temperature region without being held in the high-temperature-side temperature region. Hence, if the steel sheet is held in the temperature region of 200° C. or higher and lower than 400° C. after cooling as in PTL 6, martensite is excessively formed during cooling, resulting in excessive production of the low-temperature-region-formed bainite, etc., and consequently, the composite workability as evaluated by Erichsen test is degraded.

The holding time in the T1 temperature region satisfying Formula (1) is 5 to 180 sec. If the holding time is below 5 sec, production of the low-temperature-region-formed bainite is reduced, which prevents formation of the composite bainite phase and refinement of the MA mixed phase, and consequently, λ, bendability, and the like are degraded. Hence, the holding time is defined to be 5 sec or more, preferably 10 sec or more, more preferably 20 sec or more, and most preferably 40 sec or more. However, if the holding time exceeds 180 sec, the low-temperature-region-formed bainite is excessively formed; hence, as described later, even if the steel sheet is held for a predetermined time in the T2 temperature region, a sufficient amount of high-temperature-region-formed bainite, etc. cannot be formed. Consequently, elongation and the composite workability as evaluated by Erichsen test are degraded. Hence, the holding time is defined to be 180 sec or less, preferably 150 sec or less, more preferably 120 sec or less, and most preferably 80 sec or less.

The method of holding the steel sheet in the T1 temperature region satisfying Formula (1) is not particularly limited as long as the residence time in the T1 temperature region is 5 to 180 sec. For example, heat patterns illustrated in (i) to (iii) in FIG. 3 may be used. However, the invention is not limited thereto, and any of other heat patterns may be appropriately used as long as the requirements of the invention are satisfied.

Among the heat patterns, (i) in FIG. 3 is an example where the steel sheet is rapidly cooled from a temperature equal to or higher than the $Ac_3$ point to an appropriate temperature T satisfying Formula (1), and is then held for a predetermined time constantly at the temperature T. The steel sheet is held at the constant temperature, and then heated to an appropriate temperature satisfying Formula (2). In FIG. 3, (i) indicates a case of one-stage constant-temperature holding. However, the invention is not limited thereto, and constant-temperature holding may be performed in two or more stages with different holding temperatures as long as the temperatures are within the range of the T1 temperature region (not shown).

In FIG. 3, (ii) shows an example where the steel sheet is rapidly cooled from a temperature equal to or higher than the $Ac_3$ point to an appropriate temperature T satisfying Formula (1), and then the steel sheet is cooled with a cooling rate being altered in a predetermined time within the range of the T1 temperature region, and then the steel sheet is heated to an appropriate temperature satisfying Formula (2). In FIG. 3, (ii) indicates a case of one-stage cooling. However, the invention is not limited thereto, and multi-stage cooling may be performed in two or more stages with different cooling rates (not shown).

In FIG. 3, (iii) shows an example where the steel sheet is rapidly cooled from a temperature equal to or higher than the $Ac_3$ point to an appropriate temperature T satisfying Formula (1), and then the steel sheet is heated in a predetermined time within the range of the T1 temperature region, and then the steel sheet is heated to an appropriate temperature satisfying Formula (2). In FIG. 3, (iii) indicates a case of one-stage heating. However, the invention is not limited thereto, and multi-stage heating may be performed in two or more stages with different heating rates (not shown).

In the invention, the T2 temperature region defined in Formula (2) is specifically a region of 400° C. or higher and 540° C. or lower. The steel sheet is held for a predetermined time in this temperature region, thereby the high-temperature-region-formed bainite and the bainitic ferrite can be formed. Specifically, when the steel sheet is held in a temperature region over 540° C., soft polygonal ferrite or pseudo-perlite is formed, and desired properties are not obtained. Hence, the upper limit of the T2 temperature region is defined to be 540° C., preferably 520° C. or lower, more preferably 500° C. or lower, and most preferably 480° C. or lower. On the other hand, if the T2 temperature region is below 400° C., the high-temperature-region-formed bainite is not formed; hence, elongation and the composite workability as evaluated by Erichsen test are degraded. Hence, the lower limit of the T2 temperature region is defined to be 400° C., preferably 420° C. or higher, more preferably 425° C. or higher.

The holding time in the T2 temperature region satisfying Formula (2) is 50 sec or more. According to the invention, even if the holding time in the T2 temperature region is about 50 sec, the steel sheet is beforehand held for a predetermined time in the T1 temperature region to form the low-temperature-region-formed bainite, etc., and such low-temperature-region-formed bainite, etc. promotes formation of the high-temperature-region-formed bainite; hence, a sufficient amount of the high-temperature-region-formed bainite can be formed. However, if the holding time is shorter than 50 sec, a large amount of untransformed portion remains, and carbon thickening is insufficient. As a result, martensite transformation occurs during final cooling from the T2 temperature region. A hard MA mixed phase is therefore formed, leading to degradation of workability such as stretch-flangeability and bendability. Although the holding time in the T2 temperature region is preferably as short as possible from the viewpoint of improving productivity, the holding time is preferably 90 sec or more, and more preferably 120 sec or more in order to securely form the high-temperature-region-formed bainite. Although the upper limit of the holding time in the T2 temperature region is not particularly limited, formation of the high-temperature-region-formed bainite is saturated despite long holding, and productivity is lowered by long holding. Hence, the upper limit is preferably 1800 sec or less. The upper limit is more preferably 1500 sec or less, and most preferably 1000 sec or less.

The method of holding the steel sheet in the T2 temperature region satisfying Formula (2) is not particularly limited as long as the residence time in the T2 temperature region is 50 sec or more. As with the heat patterns in the T1 temperature region, the steel sheet may be held constantly at an appropriate temperature in the T2 temperature region, or may be cooled or heated within the T2 temperature region.

While the steel sheet is held in the T1 temperature region on the low temperature side and is then held in the T2 temperature region on the high temperature side in the invention, the inventors have confirmed that the low-temperature-region-formed bainite, etc. formed in the T1 temperature region is heated into the T2 temperature region and tempered, which does not vary a lath-to-lath distance, i.e., an average distance of retained γ and/or carbide, though recovery of substructure occurs.

An electrogalvanizing layer (EG), a hot-dip galvanizing layer (GI), or a hot-dip galvannealing layer (GA) may be formed on a surface of the cold-rolled steel sheet produced after cooling to room temperature.

A condition for forming the electrogalvanizing layer, the hot-dip galvanizing layer, or the hot-dip galvannealing layer is not particularly limited, and a usual electrogalvanizing process, a usual hot-dip galvanizing process, or a usual alloying process may be used to produce an electrogalvanizing steel sheet (an EG steel sheet), a hot-dip galvanizing steel sheet (a GI steel sheet), or an hot-dip galvannealing steel sheet (a GA steel sheet).

In the case of manufacturing the electrogalvanizing steel sheet, for example, while the cold-rolled steel sheet is dipped in a zinc solution at 55° C., current is applied to the cold-rolled steel sheet to perform electrogalvanizing.

In the case of manufacturing the hot-dip galvanizing steel sheet, for example, the cold-rolled steel sheet is dipped in a plating bath at a temperature adjusted to about 430 to 500° C. so as to be subjected to hot-dip galvanizing, and is then cooled.

In the case of manufacturing the hot-dip galvannealing steel sheet, for example, after the hot-dip galvanizing, the cold-rolled steel sheet is heated to a temperature of about 500 to 540° C. for alloying, and is then cooled.

In the case of manufacturing the hot-dip galvanizing steel sheet, after the cold-rolled steel sheet is held in the T2 temperature region, in the T2 temperature region, the cold-rolled steel sheet may be dipped in a plating bath, which is adjusted to the above-described temperature region, instead of being cooled to room temperature so as to be subjected to hot-dip galvanizing, and then may be cooled. In the case of manufacturing the hot-dip galvannealing steel sheet, in the T2 temperature region, the cold-rolled steel sheet may be successively subjected to an alloying process after the hot-dip galvanizing. In this case, time for the hot-dip galvanizing and time for the alloying process can be controlled while being included in the holding time in the T2 temperature region.

In the case of manufacturing the hot-dip galvanizing steel sheet, after the holding in the T1 temperature region, the step of holding in the T2 temperature region may be combined with the hot-dip galvanizing process. Specifically, after the holding in the T1 temperature region, the cold-rolled steel sheet may be dipped in a plating bath that is adjusted to the above-described temperature region so as to be subjected to hot-dip galvanizing in the T2 temperature region so that the hot-dip galvanizing is combined with the holding in the T2 temperature region. In the case of manufacturing the hot-dip galvannealing steel sheet, in the T2 temperature region, the cold-rolled steel sheet may be successively subjected to an alloying process after the hot-dip galvanizing.

Mass of coating is also not particularly limited, and, for example, about 10 to 100 g/m$^2$ for one side is given.

The technology of the present invention is particularly preferably used for a thin steel sheet having a thickness of 3 mm or less.

The cold-rolled steel sheet produced by the manufacturing method of the invention has a tensile strength of at least 980 MPa, and has excellent general workability. The cold-rolled steel sheet is preferably used as a material for structural components of an automobile. Examples of the structural components of the automobile include front/rear side members, a head-on collision member such as a crush box, reinforcement such as pillars (for example, center pillar reinforce), body constitutional members such as reinforcement for a roof rail, a side sill, a floor member, and a kick section, reinforcement for a bumper, a shock absorber component such as a door impact beam, and a sheet component. Since the cold-rolled steel sheet has excellent warm workability, the steel sheet can also be preferably used as a material for warm forming. The warm working refers to forming in a temperature region of roughly 50° C. to 500° C.

Embodiment

Although the invention is now described in detail with an embodiment, the invention should not be limited thereto, and it will be appreciated that modifications or alterations thereof may be appropriately made within the scope without departing from the gist described before and later, all of which are included in the technical scope of the invention.

Various types of steel having constituent compositions shown in Table 1 (the remainder consisting of iron and inevitable impurities) were vacuum-melted to fabricate experimental slabs. $Ac_3$ points were calculated based on the constituent compositions shown in Table 1 and the above-described Formula (a). Results of such calculation are further shown in Table 1. Temperatures of the calculated $Ac_3$ points are also shown in Tables 2 to 4.

The resultant experimental slabs were hot-rolled and then cold-rolled. Subsequently, the slabs were subjected to continuous annealing to fabricate test samples. Specific conditions are as follows. Specifically, each experimental slab was heated and held at 1250° C. for 30 min, and was then hot-rolled in such a manner that a rolling reduction was about 90% and finish rolling temperature was 920° C., and was then cooled from 920° C. to winding temperature of 500° C. at an average cooling rate of 30° C./sec, and was then wound. After being wound, the steel was held for 30 min at the winding temperature (500° C.), and was then furnace-cooled to room temperature to fabricate a hot-rolled steel sheet 2.6 mm in thickness. Each resultant hot-rolled steel sheet was pickled to remove surface scale, and was then cold-rolled with a cold rolling reduction of 46% to fabricate a cold-rolled steel sheet 1.4 mm in thickness. Each resultant cold-rolled steel sheet was heated to each soaking temperature (° C.) shown in Tables 2 to 4 and held at the temperature for time shown in Tables 2 to 4 so as to be soaked, and was then subjected to continuous annealing according to one of three patterns i to iii described below to fabricate each test sample.

(Pattern i; Corresponding to (i) in FIG. 3)

After soaking, each steel sheet was cooled to each start temperature T (° C.) shown in Tables 2 to 4 at each average cooling rate (° C./sec) shown in Tables 2 to 4, and was then held constantly at the start temperature T for each period (sec, step time) shown in Tables 2 to 4. Subsequently, the steel sheet was heated to each holding temperature (° C.) in the T2 temperature region shown in Tables 2 to 4, and was held at the holding temperature for each holding period shown in Tables 2 to 4.

(Pattern ii; Corresponding to (ii) in FIG. 3)

After soaking, each steel sheet was cooled to each start temperature T (° C.) shown in Tables 2 to 4 at each average cooling rate (° C./sec) shown in Tables 2 to 4, and was then cooled to each finish temperature T (° C.) shown in Tables 2 to 4 in each step time period (sec) shown in Tables 2 to 4. Subsequently, the steel sheet was heated to each holding temperature (° C.) in the T2 temperature region shown in Tables 2 to 4, and was held at the holding temperature for each holding period (sec) shown in Tables 2 to 4.

(Pattern iii; Corresponding to (iii) in FIG. 3)

After soaking, each steel sheet was cooled to each start temperature T (° C.) shown in Tables 2 to 4 at each average cooling rate (° C./sec) shown in Tables 2 to 4, and was then heated to each finish temperature (° C.) shown in Tables 2 to 4 in each step time period (sec) shown in Tables 2 to 4. Subsequently, the steel sheet was further heated to each holding temperature (° C.) in the T2 temperature region shown in Tables 2 to 4, and was held at the holding temperature for each holding time period (sec) shown in Tables 2 to 4.

Tables 2 to 4 each also show time (sec) from a time point at which constant holding in the T1 temperature region is completed to a time point at which temperature reaches the holding temperature in the T2 temperature region (in each Table, represented as time from T1 to T2). Tables 2 to 4 each further show residence time x (sec) in the T1 temperature region and residence time y (sec) in the T2 temperature region. After being held in the T2 temperature region, the steel sheet was cooled to room temperature at an average cooling rate of 5° C./sec.

Nos. 2, 9. 16, 20, 23, and 27 in Table 2 and Nos. 54 and 63 in Table 4 are examples that each do not correspond to any of the patterns i to iii. Specifically, in such examples, a temperature range in the T1 temperature region after soaking is out of the defined range, or a temperature range in the T2 temperature region is out of the defined range. In each of such examples, the start temperature T and the finish temperature in the T1 temperature region were each out of the range defined in the invention, or the holding temperature in the T2 temperature region was out of the range defined in the invention, and such temperature is shown with a mark * in each column for convenience of description.

Nos. 19, 51, and 53 are each an example where the steel sheet was cooled to the start temperature T in the T1 temperature region after soaking, and was then directly heated into the T2 temperature region without being held (step time of 0 sec).

Some of the test samples obtained after the continuous annealing were cooled to room temperature, and were then subjected to the following coating processes so that electrogalvanizing-coated steel sheets (Nos. 55, 57, 61 to 63, 66, and 67), hot-dip galvanizing-coated steel sheets (Nos. 52, 56, 59, and 64), and hot-dip galvannealing-coated steel sheets (Nos. 53, 54, 60, and 65) were produced.

[Electrogalvanizing (EG) Process]

The test samples were each dipped in a galvanizing bath at 55° C. and subjected to a electroplating process (current density 30 to 50 $A/dm^2$), and then rinsed and dried to produce the electrogalvanizing-coated steel sheet. Mass of the electrogalvanizing coating was 10 to 100 $g/m^2$ for one side.

[Hot-Dip Galvanizing (GI) Process]

The test samples were each dipped in a galvanizing bath at 450° C. and subjected to a hot-dip galvanizing process, and then cooled to room temperature to produce the hot-dip galvanizing-coated steel sheet. Mass of the hot-dip galvanizing coating was 10 to 100 $g/m^2$ for one side.

[Hot-Dip Galvannealing (GA) Process]

The test samples were each dipped in the above-described galvanizing bath and then subjected to an alloying process at 500° C., and then cooled to room temperature to produce the hot-dip galvannealing-coated steel sheet.

No. 68 in Table 4 is an example where the steel sheet was subjected to continuous annealing according to the pattern i, and was then successively subjected to the hot-dip galvanizing and the alloying process in the T2 temperature region without being cooled. Specifically, the steel sheet was held for the holding time shown in Table 4 at the holding temperature (° C.) in the T2 temperature region shown in Table 4, and was then successively dipped for 5 sec in a galvanizing bath at 460° C. so as to be subjected to hot-dip galvanizing. Subsequently, the steel sheet was heated to 500° C. and held for 20 sec at 500° C. so as to be subjected to the alloying process, and was then cooled to room temperature at an average cooling rate of 5° C./sec.

No. 69 in Table 4 is an example where the steel sheet was subjected to continuous annealing according to the pattern ii, and was then successively subjected to hot-dip galvanizing in the T2 temperature region without being cooled. Specifically, the steel sheet was held for the holding time shown in Table 4 at the holding temperature (° C.) in the T2 temperature region shown in Table 4, and was then successively dipped for 5 sec in a galvanizing bath at 460° C. so as to be subjected to hot-dip galvanizing. Subsequently, the steel sheet was slowly cooled to 440° C. in 20 sec, and was then cooled to room temperature at an average cooling rate of 5° C./sec.

In the coating process, alkaline solution immersion degreasing, rinsing, pickling, and the like were appropriately performed.

Classification of the resultant test samples is shown in Tables 2 to 4. In each Table, "Cold-rolled", "EG", "GI", and "GA" indicate, cold-rolled steel sheet, EG steel sheet, GI steel sheet, and GA steel sheet, respectively.

The resultant test samples (including the cold-rolled steel sheet, EG steel sheet, GI steel sheet, and GA steel sheet, the same applies to the following) were subjected to microstructure observation and evaluation of mechanical properties in the following procedure.

<Microstructure Observation>

In the microstructures, the area fraction of each of the high-temperature-region-formed bainite and the low-temperature-region-formed bainite, etc. (i.e., the low-temperature-region-formed bainite and tempered martensite) was calculated through SEM observation, and the volume fraction of the retained γ was determined by the saturation magnetization measurement.

[(1) Area Fraction of Each of High-Temperature-Region-Formed Bainite and Low-Temperature-Region-Formed Bainite, etc.]

A surface of a cross-section parallel to a rolling direction of each test sample was polished and further electropolished and was then nital-etched, and a ¼ thickness position was observed under a SEM of 3000 magnifications. A viewing field was about 50 μm×50 μm.

Subsequently, the average distance of retained γ and/or carbide observed white or gray in the viewing field was measured based on the above-described method. The area fraction of each of the high-temperature-region-formed bainite and the low-temperature-region-formed bainite, etc., which were distinguished from each other by such average distances, was measured by a point counting method.

Tables 5 to 7 each show the area fraction (high temperature region a, %) of the high-temperature-region-formed bainite, and the total area fraction (low temperature region b, %) of the low-temperature-region-formed bainite and the tempered martensite. Each Table further shows the sum (a+b) of the area fraction a and the total area fraction b.

[(2) Volume Fraction of Retained γ]

In microstructure, a volume fraction of retained γ was determined by the saturation magnetization measurement. Specifically, saturation magnetization (I) of a test sample and saturation magnetization (Is) of a standard sample subjected to heat treatment at 400° C. for 15 hr were measured, and the volume fraction (Vγr) of the retained γ was obtained from the following Formula. The saturation magnetization was measured at room temperature with maximum applied magnetization of 5000 (Oe) using a DC magnetization B-H characteristic autographic recorder "model BHS-40" from Riken Denshi Co., Ltd.

$$V\gamma r=(1-I/Is)\times 100$$

In the MA mixed phase including retained γ compound with quenched martensite, a number ratio of grains of the MA mixed phase, each grain having a circle-equivalent diameter d of more than 3 μm on a viewing section, in the total number of grains of the MA mixed phase was determined according to the following procedure. A surface of a cross-section parallel to a rolling direction of the test sample was polished and observed in five viewing fields by a light microscope of 1000 magnifications to measure the circle-equivalent diameter d of each grain of the MA mixed phase. The number ratio of grains of the MA mixed phase, each grain having a circle-equivalent diameter d of more than 3 μm, in the number of the observed grains of the MA mixed phase was calculated. A sample having such a number ratio of less than 15% was determined to be acceptable (○), while a sample having the number ratio of 15% or more was determined to be unacceptable (×). Such determination results are shown in Tables 5 to 7.

For the average circle-equivalent diameter D of the prior γ grains, crystal orientation was measured in three viewing fields in 0.1 μm steps over a region of an observation field of about 100 μm×100 μm by the SEM-EBSP method, and then a crystal orientation relationship between the adjacent measurement points was analyzed to specify prior γ grain boundaries, and the average circle-equivalent diameter D of the prior γ grains was calculated by a comparison method based on the specified prior γ grain boundaries. The orientation analysis by the EBSP method was conducted under a condition that a CI value was 0.1 or more.

<Evaluation of Mechanical Properties>

The mechanical properties of each test sample were evaluated based on tensile strength (TS), elongation (EL), hole expanding ratio (λ), bending limit radius (R), and Erichsen value.

(1) The tensile strength (TS) and the elongation (EL) were measured through a tensile test based on JIS Z2241 using a 5 test piece defined in JIS Z2201 cut from a test sample. The test piece was cut out such that its longitudinal direction was perpendicular to a rolling direction of the test sample. The measurement results are shown in Tables 5 to 7.

(2) The hole expanding ratio (λ) was measured through a hole expanding test based on The Japan Iron and Steel Federation Standard JFST 1001. The measurement results are shown in Tables 5 to 7.

Tables 5 to 7 each further show calculated values of "TS×EL×λ/1000".

(3) The bending limit radius (R) was measured through a V bending test. Specifically, a No. 1 test piece (thickness: 1.4 mm) defined in JIS Z2204 was cut such that its longitudinal direction was perpendicular to a rolling direction of a test sample (a bending ridge line corresponded to the rolling direction), and the V bending test was performed according to JIS Z2248. End faces in the longitudinal direction of the test piece were mechanically ground to prevent crack occurrence before the V bending test.

The bending test was conducted while an angle between a die and a punch was 60°, and radius of a punch end was varied on 0.5 mm basis, and a punch end radius above which the test piece was bendable without crack occurrence was determined as the bending limit radius (R). The measurement results are shown in Tables 5 to 7. Whether a crack occurred was determined by loupe observation, and evaluation was made with reference to no hair crack occurrence.

(4) The Erichsen value was measured through an Erichsen test based on JIS Z2247. The used test piece was cut from a test sample to have dimensions of 90 mm long, 90 mm wide, and 1.4 mm thick. The Erichsen test was conducted with a punch having a punch diameter of 20 mm. The measurement results are shown in Tables 5 to 7. The Erichsen test allows evaluation of a composite effect due to both of total elongation characteristics and local ductility of a steel sheet.

The mechanical properties of each test sample were evaluated in accordance with criteria of elongation (EL), bending limit radius (R), TS×EL×λ/1000, bending limit radius (R), and Erichsen value depending on levels of tensile strength (TS). Specifically, since a required level of each of EL, λ, TS×EL×λ/1000, R, and Erichsen value is varied depending on a TS level of a steel sheet, the mechanical properties were evaluated according to the following criteria depending on the TS levels.

According to the following criteria, a test sample, which satisfied all the properties of TS, EL, λ, TS×EL×λ/1000, R, and Erichsen value, was assumed to be acceptable ((○; excellent in general workability), and a test sample, which did not satisfy any one of the properties, was assumed to be unacceptable (×), and comprehensive evaluation was conducted. Tables 5 to 7 each show results of such comprehensive evaluation.

(1) Case of 980 MPa class TS: 980 MPa or higher and lower than 1180 MPa, EL: 14% or more, λ: 40% or more, TS (MPa)×EL (%)×λ (%)/1000: 700 or more, R: 1.5 mm or less, and Erichsen value: 10.0 mm or more (2) Case of 1180 MPa class TS: 1180 MPa or higher and lower than 1270 MPa, EL: 12% or more, λ: 35% or more, TS (MPa)×EL (%)×λ (%)/1000: 600 or more, R: 2.0 mm or less, and Erichsen value: 9.6 mm or more (3) Case of 1270 MPa class TS: 1270 MPa or higher and lower than 1370 MPa, EL: 10% or more, λ: 25% or more, TS (MPa)×EL (%)×λ (%)/1000: 500 or more, R: 3.0 mm or less, and Erichsen value: 9.4 mm or more.

In the invention, TS is assumed to be 980 MPa or higher. When a test sample has a TS of lower than 980 MPa, the test sample is not included in evaluation objects even if the test sample is excellent in each of EL, λ, TS×EL×λ/1000, R, and Erichsen value.

Tables 1 to 7 suggest the following consideration. In Nos. 1 to 69 in Tables 2 to 4, Nos. 3, 10, 11, 14, 17, 18, 19, 21, 24, 26, 29, 31, 34, 38, 41, 45, 46, 51, 53, 56, 60, 62, 64, 66, 67, and 68 are each an example where a test sample was fabricated according to the above-described pattern i. Nos. 1, 4, 5, 6, 7, 8, 13, 25, 28, 30, 32, 33, 35, 36, 39, 42, 43, 47 to 50, 52, 55, 57 to 59, 61, 65, and 69 are each an example where a test sample was fabricated according to the above-described pattern ii. Nos. 12, 15, 22, 37, 40, and 44 are each an example where a test sample was fabricated according to the above-described pattern iii. Nos. 2, 9, 16, 20, 23, 27, 54, and 63 are each an example where a test sample was fabricated under a condition corresponding to none of the patterns i to iii.

In Tables 5 to 7, each of examples, in which comprehensive evaluation is represented with ○, achieves a high-strength cold-rolled steel sheet satisfying the requirements defined in the invention, and satisfies the standard values of the mechanical properties (EL, λ, TS×EL×λ/1000, R, and Erichsen value) determined depending on levels of TS.

As clearly seen from Nos. 52, 53, 55 to 57, 59 to 62, and 64 to 69, according to the invention, even if the electrogalvanizing layer, the hot-dip galvanizing layer, or the hot-dip galvannealing layer is provided on a surface of a cold-rolled steel sheet, the standard values of the mechanical properties (EL, λ, TS×EL×λ/1000, R, and Erichsen value) determined depending on levels of TS are satisfied.

On the other hand, each of examples, in which comprehensive evaluation is represented with ×, does not satisfy one of the requirements defined in the invention. This is described in detail as follows.

No. 2 is an example where a steel sheet was held at 420° C. (corresponding to the T2 temperature region) on a high temperature side, and then held at 380° C. (corresponding to the T1 temperature region) on a low temperature side, and holding time at 420° C. was equal to time for cooling from 350° C. to 340° C. of No. 1, and holding time at 380° C. was equal to holding time at 425° C. of No. 1. Furthermore, No. 2 and No. 1 had the same cooling rate condition, and therefore took the same time for manufacturing. Comparing No. 2 with No. 1, a high-strength cold-rolled steel sheet having excellent strength and workability was achieved in No. 1 that satisfies the requirements defined in the invention. In contrast, when a steel sheet was held on a high temperature side after soaking, and then held on a low temperature side as in No. 2, holding time on the low temperature side was too short; hence, a small amount of low-temperature-region-formed bainite, etc. was formed, and bendability was degraded. In addition, since a large amount of untransformed portion was left, a coarse MA mixed phase was formed and stretch-flangeability (λ) was bad. Consequently, through comparison between No. 1 and No. 2, it is seen that the invention makes it possible to manufacture a high-strength cold-rolled steel sheet excellent in general workability at high productivity and low cost. A consideration similar to that on Nos. 1 and 2 can be made through comparison between No. 9 (a comparative example) and No. 8 (an example of the invention).

No. 7 had an extremely low average cooling rate in cooling to the appropriate temperature T in the T1 temperature region. In No. 7, therefore, ferrite was formed during the cooling, and both the low-temperature-region-formed bainite, etc. and the high-temperature-region-formed bainite were not sufficiently formed. As a result, strength was insufficient. In No. 14, soaking temperature was too low, and soaking was performed in a duplex region of ferrite and austenite. Hence, strength was low, and stretch-flangeability (λ) and bendability (R) were also bad.

In No. 15, since soaking time was too short, formation of austenite single phase was not succeeded. As a result, a large amount of ferrite remained, resulting in low strength. In addition, carbide remained undissolved, resulting in a small amount of retained γ and a low value of TS×EL×λ/1000. No. 16 is an example where the steel sheet was not held in the T1 temperature region, in which the low-temperature-region-formed bainite, etc. was substantially not formed and thus the high-temperature-region-formed bainite largely existed, and a large amount of coarse MA mixed phase was formed, resulting in bad stretch-flangeability (λ). No. 19 is an example where the holding time in the T1 temperature region was too short, in which the low-temperature-region-formed bainite, etc. was substantially not formed, and a large amount of coarse MA mixed phase was formed, resulting in low strength.

No. 20 is an example where the steel sheet was not held in the T2 temperature region, in which the high-temperature-region-formed bainite was substantially not formed. As a result, elongation (EL) was small, and Erichsen value was also low. No. 23 is an example where the steel sheet was held at a temperature (250° C.) below the T1 temperature region after soaking, and was then heated into the T2 temperature region and held therein, in which a large amount of martensite was formed during cooling after the soaking, and the low-temperature-region-formed bainite, etc. was excessively formed. As a result, a sufficient amount of high-temperature-region-formed bainite was not formed, resulting in low Erichsen value.

No. 24 is an example where the holding time in the T1 temperature region was too long, in which the low-temperature-region-formed bainite was excessively formed. As a result, a sufficient amount of high-temperature-region-formed bainite was not formed, resulting in small elongation (EL) and low Erichsen value. No. 27 is an example where the steel sheet was held in the T1 temperature region and then held at a temperature over the T2 temperature region, in which since ferrite was formed, a sufficient amount of high-temperature-region-formed bainite was not formed. Consequently, strength was insufficient. No. 28 is an example where holding time in the T2 temperature region was too short, in which a sufficient amount of high-temperature-region-formed bainite was not formed. In addition, a large amount of untransformed portion was left, and therefore a coarse MA mixed phase was formed during cooling from the T2 temperature region, resulting in bad stretch-flangeability (λ) and bad bendability (R).

No. 48 is an example where the C content was excessively small, in which TS was less than 980 MPa, i.e., the desired strength was not achieved. No. 49 is an example where the Si content was excessively small, in which TS was less than 980 MPa, i.e., the desired strength was not achieved. In addition, a small amount of retained γ was formed. No. 50 is an example where the Si content was excessively small, in which since quenching was insufficient, ferrite was formed during cooling, and formation of the high-temperature-region-formed bainite was suppressed. Consequently, TS was less than 980 MPa, i.e., strength was insufficient.

No. 51 is an example where the holding time in the T1 temperature region was too short, in which the low-temperature-region-formed bainite, etc. was substantially not formed and thus the high-temperature-region-formed bainite largely existed, and a large amount of coarse MA mixed phase was formed, resulting bad stretch-flangeability (λ).

No. 51 is a comparative example of the GA steel sheet, and is an example where the steel sheet was held at a temperature (200° C.) below the T1 temperature region after soaking, and was then heated into the T2 temperature region and held therein, in which a large amount of martensite was formed during cooling after the soaking, and the low-temperature-region-formed bainite, etc. was excessively formed. As a result, a sufficient amount of high-temperature-region-formed bainite was not formed, resulting in low Erichsen value. Furthermore, elongation (EL) was small.

No. 58 is an example where holding time in the T2 temperature region was too short, in which a sufficient amount of high-temperature-region-formed bainite was not formed. In addition, a large amount of untransformed portion was left, and therefore a coarse MA mixed phase was formed during cooling from the T2 temperature region, resulting in bad bendability (R).

No. 63 is a comparative example of the EG steel sheet, and is an example where the steel sheet was not held in the T2 temperature region, in which the high-temperature-region-formed bainite was substantially not formed and thus the low-temperature-region-formed bainite, etc. was excessively formed. As a result, Erichsen value was low.

These results reveal that the present invention makes it possible to improve productivity of a high-strength cold-rolled steel sheet improved in general workability.

TABLE 1

| Steel | Constituent Composition (mass %) | | | | | | | | | | |
|---|---|---|---|---|---|---|---|---|---|---|---|
| type | C | Si | Mn | P | S | Al | Cr | Mo | Ti | Nb | V |
| A | 0.17 | 1.41 | 2.29 | 0.02 | 0.001 | 0.04 | — | — | — | — | — |
| B | 0.17 | 1.78 | 2.28 | 0.03 | 0.002 | 0.04 | — | — | — | — | — |
| C | 0.17 | 2.18 | 2.31 | 0.03 | 0.001 | 0.05 | — | — | — | — | — |
| D | 0.12 | 1.56 | 2.44 | 0.02 | 0.001 | 0.03 | — | — | — | — | — |
| E | 0.15 | 1.35 | 2.24 | 0.01 | 0.001 | 0.04 | — | — | — | — | — |
| F | 0.23 | 1.03 | 1.59 | 0.01 | 0.002 | 0.04 | — | — | — | — | — |
| G | 0.17 | 1.23 | 1.83 | 0.02 | 0.002 | 0.02 | 0.3 | — | — | — | — |
| H | 0.12 | 1.25 | 1.83 | 0.02 | 0.002 | 0.03 | — | 0.3 | — | — | — |
| I | 0.17 | 1.21 | 2.04 | 0.02 | 0.002 | 0.02 | — | — | 0.07 | — | — |
| J | 0.14 | 1.26 | 2.07 | 0.02 | 0.001 | 0.04 | — | — | — | 0.10 | — |
| K | 0.15 | 1.28 | 2.06 | 0.02 | 0.001 | 0.03 | — | — | — | — | 0.11 |
| L | 0.13 | 1.21 | 2.01 | 0.03 | 0.002 | 0.04 | — | — | — | — | — |
| M | 0.16 | 1.22 | 2.05 | 0.02 | 0.002 | 0.03 | — | — | — | — | — |
| N | 0.11 | 1.25 | 2.03 | 0.02 | 0.002 | 0.02 | — | — | 0.02 | — | — |
| O | 0.22 | 1.26 | 2.04 | 0.03 | 0.002 | 0.04 | — | — | — | — | — |
| P | 0.15 | 1.26 | 2.01 | 0.02 | 0.001 | 0.01 | — | — | — | — | — |
| Q | 0.16 | 1.24 | 2.42 | 0.01 | 0.001 | 0.02 | — | — | — | — | — |
| R | 0.29 | 1.05 | 1.68 | 0.02 | 0.001 | 0.42 | — | — | — | — | — |
| S | 0.20 | 1.82 | 2.67 | 0.01 | 0.001 | 0.04 | — | — | — | — | — |
| T | 0.13 | 2.43 | 2.22 | 0.02 | 0.002 | 0.01 | — | — | — | — | — |
| U | 0.20 | 1.35 | 2.80 | 0.01 | 0.001 | 0.03 | — | — | — | — | — |
| V | 0.08 | 1.26 | 2.36 | 0.02 | 0.002 | 0.04 | — | — | — | — | — |
| W | 0.15 | 0.20 | 1.76 | 0.01 | 0.001 | 0.33 | — | — | — | — | — |
| X | 0.15 | 1.53 | 1.02 | 0.01 | 0.001 | 0.05 | — | — | — | — | — |

| Steel | Constituent Composition (mass %) | | | | | | | | $Ao_3$ |
|---|---|---|---|---|---|---|---|---|---|
| type | Cu | Ni | B | Ca | Mg | REM | N | O | (° C.) |
| A | — | — | — | — | — | — | 0.003 | 0.001 | 852 |
| B | — | — | — | — | — | — | 0.004 | 0.001 | 875 |
| C | — | — | — | — | — | — | 0.004 | 0.001 | 896 |
| D | — | — | — | — | — | — | 0.004 | 0.001 | 864 |
| E | — | — | — | — | — | — | 0.003 | 0.001 | 847 |
| F | — | — | 0.0002 | — | — | — | 0.005 | 0.001 | 834 |
| G | — | — | — | — | — | — | 0.003 | 0.001 | 846 |
| H | — | — | — | — | — | — | 0.004 | 0.001 | 875 |
| I | — | — | — | — | — | — | 0.002 | 0.002 | 870 |
| J | — | — | — | — | — | — | 0.004 | 0.001 | 857 |
| K | — | — | — | — | — | — | 0.004 | 0.001 | 865 |
| L | 0.20 | 0.24 | — | — | — | — | 0.002 | 0.001 | 860 |

TABLE 1-continued

| | | | | | | | | | |
|---|---|---|---|---|---|---|---|---|---|
| M | — | — | 0.0003 | — | — | — | 0.003 | 0.001 | 849 |
| N | — | — | 0.0021 | — | — | — | 0.004 | 0.001 | 869 |
| O | — | — | — | 0.0023 | — | — | 0.003 | 0.001 | 846 |
| P | — | — | — | — | 0.0019 | — | 0.004 | 0.001 | 844 |
| Q | — | — | — | — | — | 0.0027 | 0.003 | 0.001 | 826 |
| R | — | — | — | — | — | — | 0.003 | 0.001 | 980 |
| S | — | — | — | — | — | — | 0.003 | 0.001 | 843 |
| T | — | — | — | — | — | — | 0.004 | 0.001 | 896 |
| U | — | — | — | — | — | — | 0.003 | 0.001 | 814 |
| V | — | — | — | — | — | — | 0.003 | 0.001 | 870 |
| W | — | — | — | — | — | — | 0.002 | 0.001 | 925 |
| X | — | — | — | — | — | — | 0.002 | 0.002 | 895 |

TABLE 2

| | | | Soaking | | Average cooling rate | T1 temperature region | | | Time from T1 to T2 | T2 temperature region | | Residence time (sec) | | | |
|---|---|---|---|---|---|---|---|---|---|---|---|---|---|---|---|
| No. | Steel type | $Ac_3$ (° C.) | Temperature (° C.) | Time (sec) | (° C./sec) | Start temperature T (° C.) | Finish temperature (° C.) | Step time (sec) | (sec) | Holding temperature (° C.) | Holding time (sec) | T1 temperature region x | T2 temperature region y | Pattern | Classification |
| 1 | A | 852 | 880 | 200 | 30 | 350 | 340 | 30 | 15 | 425 | 150 | 42 | 159 | ii | Cold-rolled |
| 2 | A | 852 | 880 | 200 | 30 | 420 ※ | 420 ※ | 30 | 15 | 380 ※ | 150 | 0 | 0 | — | Cold-rolled |
| 3 | A | 852 | 880 | 60 | 30 | 310 | 310 | 20 | 50 | 440 | 240 | 58 | 263 | i | Cold-rolled |
| 4 | A | 852 | 880 | 200 | 30 | 330 | 320 | 5 | 5 | 425 | 240 | 11 | 246 | ii | Cold-rolled |
| 5 | A | 852 | 880 | 200 | 30 | 350 | 340 | 20 | 50 | 480 | 100 | 43 | 145 | ii | Cold-rolled |
| 6 | A | 852 | 880 | 200 | 20 | 380 | 370 | 80 | 20 | 425 | 240 | 92 | 254 | ii | Cold-rolled |
| 7 | A | 852 | 880 | 200 | 10 | 350 | 340 | 20 | 50 | 425 | 150 | 60 | 170 | ii | Cold-rolled |
| 8 | B | 875 | 900 | 200 | 60 | 390 | 380 | 20 | 4 | 440 | 150 | 22 | 161 | ii | Cold-rolled |
| 9 | B | 875 | 900 | 200 | 60 | 450 ※ | 420 ※ | 20 | 4 | 380 ※ | 150 | 0 | 0 | — | Cold-rolled |
| 10 | B | 875 | 900 | 200 | 60 | 300 | 300 | 20 | 50 | 440 | 240 | 57 | 262 | i | Cold-rolled |
| 11 | B | 875 | 900 | 200 | 60 | 350 | 350 | 20 | 50 | 425 | 600 | 54 | 622 | i | Cold-rolled |
| 12 | B | 875 | 900 | 200 | 60 | 320 | 340 | 40 | 10 | 500 | 70 | 45 | 96 | iii | Cold-rolled |
| 13 | C | 896 | 930 | 200 | 80 | 370 | 360 | 100 | 140 | 440 | 200 | 170 | 278 | ii | Cold-rolled |
| 14 | C | 896 | 860 | 200 | 80 | 350 | 350 | 20 | 10 | 425 | 240 | 27 | 248 | i | Cold-rolled |
| 15 | C | 896 | 930 | 10 | 80 | 320 | 340 | 20 | 50 | 440 | 240 | 51 | 268 | iii | Cold-rolled |
| 16 | C | 896 | 930 | 200 | 80 | 420 ※ | 420 ※ | 40 | 50 | 440 | 240 | 0 | 298 | — | Cold-rolled |
| 17 | D | 864 | 900 | 200 | 20 | 310 | 310 | 30 | 80 | 425 | 240 | 97 | 262 | i | Cold-rolled |
| 18 | D | 864 | 900 | 200 | 30 | 300 | 300 | 40 | 10 | 460 | 100 | 50 | 116 | i | Cold-rolled |
| 19 | D | 864 | 900 | 200 | 60 | 380 | 380 | 0 | 5 | 425 | 240 | 3 | 248 | i | Cold-rolled |
| 20 | D | 864 | 900 | 200 | 30 | 370 | 380 | 20 | 100 | 380 ※ | 240 | 261 | 0 | — | Cold-rolled |
| 21 | E | 847 | 900 | 200 | 20 | 320 | 320 | 20 | 70 | 425 | 240 | 77 | 262 | i | Cold-rolled |
| 22 | E | 847 | 900 | 200 | 30 | 360 | 380 | 10 | 15 | 410 | 240 | 21 | 247 | iii | Cold-rolled |
| 23 | E | 847 | 900 | 200 | 60 | 250 ※ | 250 ※ | 10 | 20 | 400 | 120 | 15 | 127 | — | Cold-rolled |
| 24 | E | 847 | 900 | 200 | 30 | 300 | 300 | 150 | 100 | 425 | 240 | 233 | 265 | i | Cold-rolled |
| 25 | F | 834 | 880 | 200 | 60 | 380 | 370 | 20 | 80 | 480 | 60 | 42 | 134 | ii | Cold-rolled |
| 26 | F | 834 | 880 | 200 | 60 | 310 | 310 | 20 | 60 | 425 | 240 | 68 | 258 | i | Cold-rolled |
| 27 | F | 834 | 880 | 200 | 60 | 350 | 370 | 30 | 50 | 600 ※ | 240 | 37 | 28 | — | Cold-rolled |
| 28 | F | 834 | 880 | 200 | 60 | 350 | 340 | 20 | 60 | 425 | 10 | 63 | 33 | ii | Cold-rolled |
| 29 | F | 834 | 930 | 500 | 60 | 300 | 300 | 50 | 30 | 425 | 240 | 76 | 251 | i | Cold-rolled |

TABLE 3

| | | | Soaking | | Average cooling rate | T1 temperature region | | | Time from T1 to T2 | T2 temperature region | | Residence time (sec) | | | |
|---|---|---|---|---|---|---|---|---|---|---|---|---|---|---|---|
| No. | Steel type | $Ac_3$ (° C.) | Temperature (° C.) | Time (sec) | (° C./sec) | Start temperature (° C.) | Finish temperature (° C.) | Step time (sec) | (sec) | Holding temperature (° C.) | Holding time (sec) | T1 temperature region x | T2 temperature region y | Pattern | Classification |
| 30 | G | 846 | 900 | 200 | 20 | 350 | 340 | 20 | 50 | 425 | 240 | 58 | 260 | ii | Cold-rolled |
| 31 | H | 875 | 900 | 200 | 20 | 320 | 320 | 20 | 50 | 425 | 240 | 62 | 257 | i | Cold-rolled |
| 32 | I | 870 | 900 | 200 | 30 | 350 | 340 | 20 | 50 | 425 | 240 | 57 | 260 | ii | Cold-rolled |
| 33 | J | 857 | 900 | 200 | 30 | 350 | 340 | 20 | 50 | 425 | 240 | 57 | 260 | ii | Cold-rolled |
| 34 | K | 865 | 900 | 200 | 30 | 320 | 320 | 20 | 50 | 425 | 240 | 61 | 257 | i | Cold-rolled |
| 35 | L | 860 | 900 | 200 | 30 | 310 | 300 | 20 | 50 | 440 | 240 | 59 | 262 | ii | Cold-rolled |
| 36 | M | 849 | 900 | 200 | 30 | 380 | 370 | 20 | 50 | 425 | 200 | 48 | 228 | ii | Cold-rolled |

TABLE 3-continued

| No. | Steel type | $Ac_3$ (° C.) | Soaking Temperature (° C.) | Soaking Time (sec) | Average cooling rate (° C./sec) | T1 temperature region Start temperature (° C.) | T1 temperature region Finish temperature (° C.) | Step time (sec) | Time from T1 to T2 (sec) | T2 temperature region Holding temperature (° C.) | T2 temperature region Holding time (sec) | Residence time (sec) T1 temperature region x | Residence time (sec) T2 temperature region y | Pattern | Classification |
|---|---|---|---|---|---|---|---|---|---|---|---|---|---|---|---|
| 37 | M | 849 | 930 | 500 | 30 | 360 | 380 | 20 | 150 | 440 | 150 | 71 | 258 | iii | Cold-rolled |
| 38 | M | 849 | 900 | 200 | 30 | 310 | 310 | 30 | 20 | 480 | 40 | 44 | 65 | i | Cold-rolled |
| 39 | M | 849 | 900 | 200 | 30 | 350 | 340 | 15 | 100 | 440 | 600 | 77 | 648 | ii | Cold-rolled |
| 40 | N | 869 | 900 | 200 | 30 | 300 | 320 | 20 | 50 | 425 | 240 | 61 | 257 | iii | Cold-rolled |
| 41 | O | 846 | 900 | 200 | 60 | 380 | 380 | 20 | 100 | 425 | 240 | 65 | 301 | i | Cold-rolled |
| 42 | P | 844 | 880 | 200 | 60 | 350 | 340 | 20 | 50 | 425 | 240 | 56 | 260 | ii | Cold-rolled |
| 43 | Q | 826 | 880 | 200 | 30 | 350 | 340 | 20 | 50 | 425 | 240 | 57 | 260 | ii | Cold-rolled |
| 44 | R | 980 | 1000 | 200 | 60 | 380 | 390 | 20 | 100 | 440 | 50 | 40 | 138 | iii | Cold-rolled |
| 45 | S | 843 | 880 | 200 | 20 | 300 | 300 | 50 | 100 | 410 | 600 | 146 | 611 | i | Cold-rolled |
| 46 | T | 896 | 930 | 200 | 60 | 320 | 320 | 20 | 50 | 425 | 240 | 59 | 257 | i | Cold-rolled |
| 47 | U | 814 | 880 | 200 | 30 | 320 | 310 | 50 | 80 | 425 | 240 | 115 | 262 | ii | Cold-rolled |
| 48 | V | 870 | 900 | 200 | 60 | 350 | 340 | 20 | 50 | 425 | 240 | 56 | 260 | ii | Cold-rolled |
| 49 | W | 925 | 950 | 200 | 30 | 350 | 340 | 20 | 50 | 425 | 240 | 57 | 260 | ii | Cold-rolled |
| 50 | X | 895 | 930 | 200 | 60 | 350 | 340 | 20 | 50 | 425 | 240 | 56 | 260 | ii | Cold-rolled |

TABLE 4

| No. | Steel type | $Ac_3$ (° C.) | Soaking Temperature (° C.) | Soaking Time (sec) | Average cooling rate (° C./sec) | T1 temperature region Start temperature (° C.) | T1 temperature region Finish temperature (° C.) | Step time (sec) | Time from T1 to T2 (sec) | T2 temperature region Holding temperature (° C.) | T2 temperature region Holding time (sec) | Residence time (sec) T1 temperature region x | Residence time (sec) T2 temperature region y | Pattern | Classification |
|---|---|---|---|---|---|---|---|---|---|---|---|---|---|---|---|
| 51 | A | 852 | 880 | 200 | 30 | 350 | 350 | 0 | 5 | 440 | 240 | 4 | 250 | i | Cold-rolled |
| 52 | A | 852 | 880 | 70 | 30 | 320 | 300 | 10 | 5 | 420 | 50 | 17 | 55 | ii | GI |
| 53 | A | 852 | 880 | 100 | 30 | 300 | 300 | 0 | 20 | 400 | 60 | 23 | 60 | i | GA |
| 54 | A | 852 | 880 | 200 | 30 | 200 ※ | 200 ※ | 30 | 20 | 440 | 200 | 12 | 220 | — | GA |
| 55 | A | 852 | 880 | 200 | 30 | 320 | 300 | 30 | 40 | 440 | 200 | 61 | 219 | ii | EG |
| 56 | D | 864 | 900 | 100 | 30 | 300 | 300 | 50 | 20 | 450 | 200 | 67 | 217 | i | GI |
| 57 | D | 864 | 900 | 200 | 30 | 350 | 330 | 20 | 20 | 410 | 200 | 39 | 205 | ii | EG |
| 58 | E | 847 | 900 | 200 | 30 | 390 | 380 | 20 | 20 | 420 | 30 | 30 | 44 | ii | Cold-rolled |
| 59 | E | 847 | 900 | 100 | 30 | 350 | 330 | 50 | 20 | 440 | 100 | 64 | 115 | ii | GI |
| 60 | E | 847 | 900 | 60 | 30 | 300 | 300 | 20 | 20 | 420 | 200 | 40 | 207 | i | GA |
| 61 | E | 847 | 900 | 60 | 30 | 380 | 350 | 40 | 30 | 420 | 200 | 62 | 213 | ii | EG |
| 62 | E | 847 | 900 | 200 | 30 | 320 | 320 | 5 | 20 | 420 | 240 | 24 | 248 | i | EG |
| 63 | E | 847 | 900 | 200 | 30 | 350 | 350 | 20 | 20 | 360 ※ | 400 | 422 | 0 | — | EG |
| 64 | M | 849 | 900 | 70 | 30 | 330 | 330 | 50 | 40 | 440 | 240 | 78 | 263 | i | GI |
| 65 | M | 849 | 900 | 70 | 30 | 320 | 300 | 30 | 40 | 420 | 200 | 66 | 211 | ii | GA |
| 66 | M | 849 | 900 | 100 | 30 | 380 | 380 | 20 | 20 | 420 | 200 | 31 | 214 | i | EG |
| 67 | M | 849 | 900 | 200 | 30 | 300 | 300 | 20 | 20 | 400 | 200 | 43 | 200 | i | EG |
| 68 | M | 849 | 900 | 200 | 30 | 300 | 300 | 50 | 20 | 420 | 15 | 70 | 63 | i | GA |
| 69 | M | 849 | 900 | 200 | 30 | 340 | 320 | 30 | 20 | 430 | 20 | 47 | 58 | ii | GI |

TABLE 5

| No. | Steel type | Composite structure High-temperature region a (area percent) | Composite structure Low-temperature region b (area percent) | a + b (area percent) | Retained γ (volume percent) | Number ratio of MA mixed phase grains | Prior γ grain size (μm) | TS (MPa) | EL (%) | λ (%) | TS × EL × λ/1000 | R (mm) | Erichsen value (mm) | Comprehensive evaluation | Remarks |
|---|---|---|---|---|---|---|---|---|---|---|---|---|---|---|---|
| 1 | A | 42 | 51 | 93 | 12 | ○ | ○ | 997 | 16 | 58 | 925 | 0.5 | 10.2 | ○ | 980 MPa class |
| 2 | A | 51 | 16 | 67 | 15 | x | ○ | 1045 | 17 | 36 | 640 | 2.0 | 10.4 | x | 980 MPa class |
| 3 | A | 33 | 59 | 92 | 11 | ○ | ○ | 1022 | 15 | 72 | 1104 | 0.0 | 10.2 | ○ | 980 MPa class |
| 4 | A | 45 | 49 | 94 | 11 | ○ | ○ | 1008 | 16 | 60 | 968 | 0.0 | 10.4 | ○ | 980 MPa class |
| 5 | A | 43 | 46 | 89 | 12 | ○ | ○ | 982 | 16 | 66 | 1037 | 0.5 | 10.3 | ○ | 980 MPa class |

TABLE 5-continued

| No. | Steel type | Composite structure: High-temperature region a (area percent) | Composite structure: Low-temperature region b (area percent) | a + b (area percent) | Retained γ (volume percent) | Number ratio of MA mixed phase grains | Prior γ grain size (μm) | TS (MPa) | EL (%) | λ (%) | TS × EL × λ/1000 | R (mm) | Erichsen value (mm) | Comprehensive evaluation | Remarks |
|---|---|---|---|---|---|---|---|---|---|---|---|---|---|---|---|
| 6 | A | 28 | 63 | 91 | 9 | ○ | ○ | 1036 | 14 | 68 | 986 | 0.0 | 10.2 | ○ | 980 MPa class |
| 7 | A | 33 | 30 | 63 | 14 | ○ | ○ | 944 | 20 | 26 | 491 | 2.0 | 10.5 | x | — |
| 8 | B | 47 | 42 | 89 | 12 | ○ | ○ | 1045 | 20 | 45 | 941 | 0.5 | 10.6 | ○ | 980 MPa class |
| 9 | B | 42 | 24 | 66 | 16 | x | ○ | 1069 | 19 | 32 | 650 | 1.0 | 10.3 | x | 980 MPa class |
| 10 | B | 37 | 53 | 90 | 12 | ○ | ○ | 1037 | 20 | 59 | 1224 | 0.0 | 10.4 | ○ | 980 MPa class |
| 11 | B | 39 | 46 | 85 | 12 | ○ | ○ | 1022 | 19 | 68 | 1320 | 0.5 | 10.6 | ○ | 960 MPa class |
| 12 | B | 35 | 57 | 92 | 12 | ○ | ○ | 1049 | 18 | 47 | 887 | 0.5 | 10.5 | ○ | 980 MPa class |
| 13 | C | 42 | 54 | 96 | 12 | ○ | ○ | 1067 | 18 | 60 | 1152 | 0.5 | 10.4 | ○ | 980 MPa class |
| 14 | C | 31 | 24 | 55 | 16 | ○ | ○ | 971 | 24 | 27 | 629 | 2.0 | 10.4 | x | — |
| 15 | C | 18 | 46 | 64 | 2 | ○ | ○ | 915 | 17 | 35 | 544 | 0.5 | 10.1 | x | — |
| 16 | C | 81 | 7 | 88 | 16 | x | ○ | 1031 | 22 | 17 | 386 | 0.5 | 10.5 | x | 980 MPa class |
| 17 | D | 36 | 52 | 88 | 11 | ○ | ○ | 1025 | 16 | 55 | 902 | 0.5 | 10.4 | ○ | 980 MPa class |
| 18 | D | 41 | 45 | 86 | 11 | ○ | ○ | 1002 | 15 | 66 | 992 | 0.0 | 10.5 | ○ | 980 MPa class |
| 19 | D | 72 | 17 | 89 | 15 | x | ○ | 956 | 15 | 26 | 373 | 1.5 | 9.8 | x | — |
| 20 | D | 12 | 82 | 94 | 8 | ○ | ○ | 1095 | 12 | 63 | 828 | 1.0 | 9.9 | x | 980 MPa class |
| 21 | E | 31 | 54 | 85 | 12 | ○ | ○ | 993 | 17 | 64 | 1080 | 0.0 | 10.2 | ○ | 980 MPa class |
| 22 | E | 42 | 49 | 91 | 11 | ○ | ○ | 987 | 17 | 60 | 1007 | 0.0 | 10.4 | ○ | 980 MPa class |
| 23 | E | 10 | 84 | 94 | 5 | ○ | ○ | 1224 | 12 | 52 | 764 | 2.0 | 9.4 | x | 1180 MPa class |
| 24 | E | 16 | 81 | 97 | 4 | ○ | ○ | 1196 | 8 | 61 | 584 | 2.0 | 9.5 | x | 1180 MPa class |
| 25 | F | 36 | 49 | 85 | 12 | ○ | ○ | 1055 | 20 | 48 | 1013 | 1.0 | 10.4 | ○ | 980 MPa class |
| 26 | F | 31 | 59 | 90 | 9 | ○ | ○ | 1195 | 17 | 41 | 833 | 2.0 | 10.0 | ○ | 1180 MPa class |
| 27 | F | 13 | 54 | 67 | 2 | ○ | ○ | 896 | 17 | 54 | 823 | 0.5 | 10.5 | x | — |
| 28 | F | 17 | 51 | 68 | 4 | x | ○ | 1093 | 20 | 20 | 437 | 2.0 | 10.4 | x | 980 MPa class |
| 29 | F | 22 | 68 | 90 | 10 | ○ | Δ | 1301 | 12 | 40 | 624 | 2.5 | 9.5 | ○ | 1270 MPa class |

TABLE 6

| No. | Steel type | Composite structure: High-temperature region a (area percent) | Composite structure: Low-temperature region b (area percent) | a + b (area percent) | Retained γ (volume percent) | Number ratio of MA mixed phase grains | Prior γ grain size (μm) | TS (MPa) | EL (%) | λ (%) | TS × EL × λ/1000 | R (mm) | Erichsen value (mm) | Comprehensive evaluation | Remarks |
|---|---|---|---|---|---|---|---|---|---|---|---|---|---|---|---|
| 30 | G | 50 | 45 | 95 | 12 | ○ | ○ | 1044 | 17 | 63 | 1118 | 0.5 | 10.3 | ○ | 980 MPa class |
| 31 | H | 38 | 54 | 92 | 11 | ○ | ○ | 1010 | 16 | 66 | 1067 | 0.0 | 10.5 | ○ | 980 MPa class |
| 32 | I | 50 | 45 | 95 | 13 | ○ | ○ | 998 | 18 | 56 | 1006 | 0.5 | 10.4 | ○ | 980 MPa class |
| 33 | J | 52 | 40 | 92 | 12 | ○ | ○ | 1006 | 17 | 50 | 855 | 0.5 | 10.4 | ○ | 980 MPa class |
| 34 | K | 43 | 49 | 92 | 10 | ○ | ○ | 992 | 16 | 68 | 1079 | 0.0 | 10.4 | ○ | 980 MPa class |
| 35 | L | 36 | 54 | 90 | 12 | ○ | ○ | 1041 | 16 | 63 | 1049 | 0.0 | 10.5 | ○ | 980 MPa class |
| 36 | M | 45 | 51 | 96 | 11 | ○ | ○ | 1017 | 17 | 67 | 1158 | 0.0 | 10.3 | ○ | 980 MPa class |
| 37 | M | 37 | 57 | 94 | 12 | ○ | Δ | 990 | 15 | 59 | 876 | 1.0 | 10.2 | ○ | 980 MPa class |
| 38 | M | 31 | 68 | 99 | 10 | ○ | ○ | 1036 | 16 | 57 | 945 | 0.5 | 10.2 | ○ | 980 MPa class |
| 39 | M | 37 | 55 | 92 | 11 | ○ | ○ | 986 | 17 | 55 | 922 | 0.0 | 10.4 | ○ | 980 MPa class |
| 40 | N | 30 | 65 | 95 | 9 | ○ | ○ | 1022 | 15 | 71 | 1088 | 0.0 | 10.3 | ○ | 980 MPa class |
| 41 | O | 56 | 37 | 93 | 13 | ○ | ○ | 1032 | 20 | 48 | 991 | 1.0 | 10.4 | ○ | 980 MPa class |
| 42 | P | 44 | 47 | 91 | 11 | ○ | ○ | 985 | 17 | 68 | 1139 | 0.0 | 10.5 | ○ | 980 MPa class |
| 43 | Q | 47 | 46 | 93 | 11 | ○ | ○ | 1000 | 17 | 59 | 1003 | 0.0 | 10.4 | ○ | 980 MPa class |
| 44 | R | 53 | 38 | 91 | 14 | ○ | Δ | 1226 | 15 | 41 | 754 | 2.0 | 10.0 | ○ | 1180 MPa class |
| 45 | S | 33 | 66 | 99 | 10 | ○ | ○ | 1212 | 17 | 47 | 968 | 1.5 | 10.0 | ○ | 1180 MPa class |
| 46 | T | 39 | 54 | 93 | 12 | ○ | ○ | 1028 | 18 | 62 | 1147 | 0.0 | 10.4 | ○ | 980 MPa class |
| 47 | U | 35 | 61 | 96 | 9 | ○ | ○ | 1244 | 14 | 49 | 853 | 1.0 | 9.9 | ○ | 1180 MPa class |
| 48 | V | 49 | 51 | 100 | 3 | ○ | ○ | 926 | 16 | 76 | 1126 | 0.0 | 10.2 | x | — |
| 49 | W | 33 | 57 | 90 | 2 | ○ | Δ | 969 | 15 | 54 | 785 | 0.5 | 10.0 | x | — |
| 50 | X | 10 | 49 | 59 | 5 | x | ○ | 883 | 20 | 32 | 565 | 1.5 | 10.4 | x | — |

TABLE 7

| No. | Steel type | Composite structure: High-temperature region a (area percent) | Low-temperature region b (area percent) | a + b (area percent) | Retained γ (volume percent) | Number ratio of MA mixed phase grains | Prior γ grain size (μm) | TS (MPa) | EL (%) | λ (%) | TS × EL × λ/1000 | R (mm) | Erichsen value (mm) | Comprehensive evaluation | Remarks |
|---|---|---|---|---|---|---|---|---|---|---|---|---|---|---|---|
| 51 | A | 81 | 12 | 93 | 14 | x | ○ | 1036 | 20 | 35 | 725 | 1.0 | 10.5 | x | 980 MPa class |
| 52 | A | 38 | 53 | 91 | 13 | ○ | ○ | 1021 | 15 | 49 | 750 | 0.5 | 10.2 | ○ | 980 MPa class |
| 53 | A | 32 | 59 | 91 | 14 | ○ | ○ | 982 | 16 | 52 | 817 | 0.5 | 10.4 | ○ | 980 MPa class |
| 54 | A | 7 | 86 | 93 | 10 | ○ | ○ | 1073 | 13 | 55 | 767 | 0.0 | 9.8 | x | 980 MPa class |
| 55 | A | 30 | 61 | 91 | 12 | ○ | ○ | 1012 | 16 | 68 | 1101 | 0.0 | 10.3 | ○ | 980 MPa class |
| 56 | D | 39 | 52 | 91 | 11 | ○ | ○ | 995 | 15 | 72 | 1075 | 0.0 | 10.3 | ○ | 980 MPa class |
| 57 | D | 48 | 43 | 91 | 12 | ○ | ○ | 1026 | 15 | 53 | 816 | 0.5 | 10.3 | ○ | 980 MPa class |
| 58 | E | 15 | 46 | 61 | 15 | x | ○ | 1081 | 16 | 41 | 709 | 2.0 | 10.2 | x | 980 MPa class |
| 59 | E | 33 | 58 | 91 | 12 | ○ | ○ | 1023 | 15 | 64 | 982 | 0.0 | 10.3 | ○ | 980 MPa class |
| 60 | E | 37 | 55 | 92 | 13 | ○ | ○ | 988 | 16 | 72 | 1138 | 0.0 | 10.4 | ○ | 980 MPa class |
| 61 | E | 44 | 52 | 96 | 12 | ○ | ○ | 1004 | 16 | 55 | 884 | 0.5 | 10.4 | ○ | 980 MPa class |
| 62 | E | 51 | 43 | 94 | 14 | ○ | ○ | 1022 | 15 | 67 | 1027 | 0.0 | 10.2 | ○ | 980 MPa class |
| 63 | E | 5 | 87 | 92 | 9 | ○ | ○ | 1145 | 14 | 66 | 1058 | 0.5 | 9.8 | x | 980 MPa class |
| 64 | M | 38 | 55 | 93 | 14 | ○ | ○ | 1000 | 17 | 59 | 1003 | 0.0 | 10.4 | ○ | 980 MPa class |
| 65 | M | 44 | 51 | 95 | 13 | ○ | ○ | 993 | 15 | 72 | 1072 | 0.0 | 10.2 | ○ | 980 MPa class |
| 86 | M | 53 | 41 | 94 | 14 | ○ | ○ | 1035 | 15 | 65 | 1009 | 0.0 | 10.3 | ○ | 980 MPa class |
| 87 | M | 29 | 66 | 95 | 11 | ○ | ○ | 1202 | 14 | 61 | 1027 | 1.0 | 9.9 | ○ | 1180 MPa class |
| 68 | M | 28 | 61 | 89 | 13 | ○ | ○ | 988 | 16 | 66 | 1043 | 0.5 | 10.2 | ○ | 980 MPa class |
| 69 | M | 45 | 48 | 93 | 13 | ○ | ○ | 1023 | 15 | 64 | 982 | 0.0 | 10.3 | ○ | 980 MPa class |

The invention claimed is:

1. A method of manufacturing a high-strength cold-rolled steel sheet having excellent workability, the steel sheet satisfying, by mass percent, C: 0.10 to 0.3%, Si: 1.0 to 3%, Mn: 1.5 to 3%, Al: 0.005 to 3%, P: 0.1% or less, and S: 0.05% or less, the remainder comprising iron and inevitable impurities, a microstructure of the steel sheet including bainite, retained austenite, and tempered martensite, wherein (1) when the microstructure is observed by a scanning electron microscope, the bainite is composed of a composite structure of high-temperature-region-formed bainite, in which an average distance between adjacent retained-austenite grains and/or carbide particles is 1 μm or more, and low-temperature-region-formed bainite, in which an average distance between adjacent retained-austenite grains and/or carbide particles is less than 1 μm, and when an area fraction of the high-temperature-region-formed bainite in the entire microstructure is denoted as "a", and when a total area fraction of the low-temperature-region-formed bainite and the tempered martensite in the entire microstructure is denoted as "b", a: 20 to 80%, b: 20 to 80%, and a+b: 70% or more are satisfied, and (2) a volume fraction of the retained austenite determined by saturation magnetization measurement is 3% or more with respect to the entire microstructure, the method being characterized in that steel satisfying the above-described constituent composition is:

held for 50 sec or more at a temperature equal to or higher than a $Ac_3$ point so as to be soaked, and then cooled to a temperature T1 satisfying Formula (1) at an average cooling rate of 20° C./sec or higher, and held in a temperature region satisfying Formula (1) for 5 to 180 sec, and then heated into a temperature region satisfying Formula (2) and held in the temperature region for 50 sec or more, and then cooled;

$$310° \text{ C.} \leq T1(° \text{ C.}) < 400° \text{ C.} \quad (1)$$

$$400° \text{ C.} \leq T2(° \text{ C.}) \leq 540° \text{ C.} \quad (2).$$

2. The manufacturing method according to claim 1, wherein the steel further comprises Cr: 1% or less (not including 0%) and/or Mo: 1% or less (not including 0%).

3. The manufacturing method according to claim 1, wherein the steel further comprises at least one element selected from the group consisting of Ti: 0.15% or less (not including 0%), Nb: 0.15% or less (not including 0%), and V: 0.15% or less (not including 0%).

4. The manufacturing method according to claim 1, wherein the steel further comprises Cu: 1% or less (not including 0%) and/or Ni: 1% or less (not including 0%).

5. The manufacturing method according to claim 1, wherein the steel further comprises B: 0.005% or less (not including 0%).

6. The manufacturing method according to claim 1, wherein the steel further comprises at least one element selected from the group consisting of Ca: 0.01% or less (not including 0%), Mg: 0.01% or less (not including 0%), and rare earth elements: 0.01% or less (not including 0%).

7. The manufacturing method according to claim 1, wherein when the microstructure has a MA mixed phase including quenched martensite compound with retained austenite, a ratio of the number of grains of the MA mixed phase, each grain having a circle-equivalent diameter d satisfying more than 3 μm on a viewing section, in the total number of grains of the MA mixed phase, is less than 15% (including 0%).

8. The manufacturing method according to claim 1, wherein the average circle-equivalent diameter D of prior austenite grains is 20 μm or less (not including 0 μm).

9. The manufacturing method according to claim 1, wherein the steel sheet is held in the temperature region satisfying Formula (2) and then cooled, and is then subjected to one of electrogalvanizing, hot-dip galvanizing, and hot-dip galvannealing.

10. The manufacturing method according to claim 1, wherein the steel sheet is subjected to one of hot-dip galvanizing and hot-dip galvannealing in the temperature region satisfying Formula (2).

11. The manufacturing method according to claim 1, wherein the steel is cooled to a temperature T1 satisfying 310° C.≤T1 (° C.)<400° C. at an average cooling rate of 25° C./sec or higher.

12. The manufacturing method according to claim 1, wherein the steel is cooled to a temperature T1 satisfying 310° C.≤T1 (° C.)<400° C. at an average cooling rate of 20° C./sec or higher and held at T1 for 5 to 180 sec.

13. A method of manufacturing a high-strength cold-rolled steel sheet having excellent workability, the steel sheet satisfying, by mass percent, C: 0.10 to 0.3%, Si: 1.0 to 3%, Mn: 1.5 to 3%, Al: 0.005 to 3%, P: 0.1% or less, and S: 0.05% or less, the remainder comprising iron and inevitable impurities, a microstructure of the steel sheet including bainite, retained austenite, and tempered martensite, wherein (1) when the microstructure is observed by a scanning electron microscope, the bainite is composed of a composite structure of high-temperature-region-formed bainite, in which an average distance between adjacent retained-austenite grains and/or carbide particles is 1 μm or more, and low-temperature-region-formed bainite, in which an average distance between adjacent retained-austenite grains and/or carbide particles is less than 1 μm, and when an area fraction of the high-temperature-region-formed bainite in the entire microstructure is denoted as "a", and when a total area fraction of the low-temperature-region-formed bainite and the tempered martensite in the entire microstructure is denoted as "b", a: 20 to 80%, b: 20 to 80%, and a+b: 70% or more are satisfied, and (2) a volume fraction of the retained austenite determined by saturation magnetization measurement is 3% or more with respect to the entire microstructure, the method being characterized in that steel satisfying the above-described constituent composition is held for 50 sec or more at a temperature equal to or higher than a $Ac_3$ point so as to be soaked, and then cooled to a temperature T1 satisfying Formula (1) at an average cooling rate of 25° C./sec or higher, and held in a temperature region satisfying Formula (1) for 5 to 180 sec, and then heated into a temperature region satisfying Formula (2) and held in the temperature region for 50 sec or more, and then cooled;

$$300° \text{ C.} \leq T1(° \text{ C.}) < 400° \text{ C.} \quad (1)$$

$$400° \text{ C.} \leq T2(° \text{ C.}) < 540° \text{ C.} \quad (2).$$

14. The manufacturing method according to claim 13, wherein the steel is cooled to a temperature T1 satisfying 300° C.≤T1 (° C.)<400° C. at an average cooling rate of 25° C./sec or higher and held at T1 for 5 to 180 sec.

* * * * *